US008187090B2

(12) United States Patent
Kondo

(10) Patent No.: US 8,187,090 B2
(45) Date of Patent: May 29, 2012

(54) CONJURING ASSISTING TOY

(75) Inventor: Hiroshi Kondo, Tokyo (JP)

(73) Assignees: Nintendo Co., Ltd., Kyoto (JP); Tenyo Co., Ltd., Tokyo (JP)

( * ) Notice: Subject to any disclaimer, the term of this patent is extended or adjusted under 35 U.S.C. 154(b) by 1231 days.

(21) Appl. No.: 11/875,048

(22) Filed: Oct. 19, 2007

(65) Prior Publication Data

US 2008/0274807 A1 Nov. 6, 2008

(30) Foreign Application Priority Data

Oct. 26, 2006 (JP) ..... 2006-290651

(51) Int. Cl.

| | |
|---|---|
| ***A63F 13/00*** | (2006.01) |
| ***A63F 9/24*** | (2006.01) |
| ***G06F 17/00*** | (2006.01) |
| *A63F 13/06* | (2006.01) |
| *A63F 13/10* | (2006.01) |

(52) U.S. Cl. ..... 463/31; 463/7; 463/30; 463/34; 463/37; 273/317.1; 273/461; 345/24; 345/467; 345/473; 345/683; 348/121; 348/135; 348/589; 434/44; 434/257

(58) Field of Classification Search ..... 463/1–5, 463/7–9, 30–34, 36–43, 49–57; 273/108.1, 273/127 R, 148 R, 148 B, 309, 317.1, 340, 273/343, 348, 361–367, 461; 345/1.1–1.3, 345/2.1–2.3, 3.1–3.4, 24, 419, 467–469, 345/473, 539, 543–544, 625, 636, 638, 653–656, 345/664–666, 682–683, 686, 949–950, FOR. 139, 345/FOR. 153; 348/14.15, 39, 42, 47–52, 348/115, 117, 121, 135–137, 141, 211.2, 348/211.4, 211.7–211.8, 211.14, 211.99, 348/576, 588–589, 719, 721, 734, E13.004, 348/E13.064–E13.067; 375/240.15–240.16, 375/240.25; 434/37–38, 43–44, 69, 118, 240, 256–257; *A63F 13/00, 13/06, 13/10, 09/24; G06F 17/00*

See application file for complete search history.

(56) References Cited

U.S. PATENT DOCUMENTS 6,321,158 B1 * 11/2001 DeLorme et al. ..... 701/426

(Continued)

FOREIGN PATENT DOCUMENTS

JP 2000-116940 4/2000

(Continued)

*Primary Examiner* — Arthur O. Hall

(74) *Attorney, Agent, or Firm* — The Marbury Law Group PLLC

(57) ABSTRACT

The invention provides a conjuring assisting toy which can make a viewer feel the supernatural force and interestedness which are inherent in a conjuring trick by displaying the result of a conjuring trick through simple operations, there is provided a conjuring assisting toy including a display means for displaying an image, a coordinate inputting means for designating coordinates relative to a display area of the display means, and a central control means, wherein the central control means includes a main control unit, a conjuring data storage unit, an input analyzing unit and an operation unit, an operation result storage unit, an inputted diagram storage unit, and an image data forming and outputting unit, an inputted position signal is analyzed by the input analyzing unit, the main control unit causes position information based on the inputted position signal to be stored in the inputted diagram storage unit, causes the display means to display a line image, determines specific feature information from information stored in the conjuring data storage unit based on an input order, and causes part or the whole of the line image which is caused to be displayed on the display means to be changed to display a time-varying image.

6 Claims, 14 Drawing Sheets

U.S. PATENT DOCUMENTS

| | | | | |
|---|---|---|---|---|
| 6,468,161 | B1 * | 10/2002 | Shimomura | 463/43 |
| 6,597,378 | B1 * | 7/2003 | Shiraishi et al. | 715/764 |
| 6,646,642 | B1 * | 11/2003 | Kanetaka et al. | 345/473 |
| 6,757,833 | B2 * | 6/2004 | Wakai et al. | 726/4 |
| 6,827,644 | B2 * | 12/2004 | Kondo | 463/7 |
| 6,873,905 | B2 * | 3/2005 | Endo et al. | 701/416 |
| 7,283,671 | B2 * | 10/2007 | Hiroi et al. | 382/187 |
| 7,352,385 | B2 * | 4/2008 | Kakii et al. | 348/14.07 |
| 7,990,385 | B2 * | 8/2011 | Kake et al. | 345/473 |
| 2001/0027375 | A1 * | 10/2001 | Machida et al. | 701/209 |
| 2004/0174365 | A1 * | 9/2004 | Bub | 345/473 |
| 2005/0201594 | A1 * | 9/2005 | Mori et al. | 382/107 |

FOREIGN PATENT DOCUMENTS

| | | |
|---|---|---|
| JP | 2001-087548 | 4/2001 |
| JP | 2002-078988 | 3/2002 |

* cited by examiner

CONJURING ASSISTING TOY

CROSS-REFERENCE TO RELATED APPLICATION

This application is based upon and claims the benefit of priority from the prior Japanese Patent Application No. 2006-290651, filed on Oct. 26, 2006, the entire contents of which are incorporated herein by reference.

BACKGROUND OF THE INVENTION

1. Field of the Invention

The present invention relates to a game machine which incorporates a microcomputer, and more particularly, to a game machine, which may be portable, as a conjuring assisting toy which can be played with by playing a conjuring trick game through input of pictures via a display screen.

2. Description of Background Art

Currently, the Japanese Unexamined Patent Application No. 2002-078986 proposes a conjuring trick game system as one in which terminal equipment is used to enjoy playing a conjuring trick game.

This conjuring trick game system is such that when information regarding a conjuring trick is received on terminal equipment, which may be portable, from a web server, pictures representing stages at which the conjuring trick is performed are displayed on the terminal equipment, and a selection of a position of a specific picture among those representing a conjuror and conjuring tools which are displayed on a display screen of the terminal equipment is implemented by an input through a button, whereby the conjuring trick is made to progress on the display screen by switching sequentially screens displayed on the terminal equipment.

In addition, various types of television game machines equipped with a liquid crystal display device have been proposed and put into practical use as is described in the Japanese Unexamined Patent Application No. 2000-116940 and the Japanese Unexamined Patent Application No. 2001-087548.

SUMMARY OF THE INVENTION

As has been described above, in various types of terminal equipment which incorporates a microcomputer and some of which are portable, although various types of conjuring tricks can be performed by programs sent from a web server, when making the game progress, key or button operations become necessary to input instructions, and since it is well known that a computer can basically perform various operations based on key operations, there have been caused occasions where the supernatural force and interestedness which are inherent in a conjuring trick are reduced.

The present invention has been made in these situations, and an object thereof is to provide a game machine as a conjuring assisting toy which can make a viewer feel the supernatural force and interestedness which are inherent in a conjuring trick by displaying the result of a conjuring trick through simple operations.

According to an aspect of the present invention, there is provided a conjuring assisting toy (100) including a display means (135) for displaying an image, a coordinate inputting means for designating coordinates relative to a display area of the display means (135), and a central control means (110), wherein the central control means (110) includes a main control unit (112), a conjuring data storage unit (125), an input analyzing unit (114) and an operation unit (116), an operation result storage unit (122), an inputted diagram storage unit (120), and an image data forming and outputting unit (118), the input analyzing unit (114) analyzes an inputted position signal from the coordinate inputting means, the main control unit (112) causes position information based on the inputted position signal which is sent from the input analyzing unit (114) to be stored in the inputted diagram storage unit (120), causes the display means (135) to display a line image, which is inputted by designating coordinates relative to the display area, by causing diagram data to be outputted from the image data forming and outputting unit (118) based on the position information, and when the operation unit (116) determines specific feature information from the information stored in the conjuring data storage unit (125), causes part or the whole of the line image which is caused to be displayed on the display means (135) by the image data forming and outputting unit (118) to be changed to display a time-varying image or causes data to be outputted which allows a picture image or text image based on the specific feature information so determined to be added to the image which has already been displayed for display together with the image, and wherein the conjuring data storage unit (125) stores feature information of conjuring tools, and the operation unit (116) selects and determines specific feature information from the conjuring data storage unit (125) based on drawing order information on an inputted diagram which is inputted from the coordinate inputting means and input starting position information on the inputted diagram.

In addition, the conjuring assisting toy (100) has a speech generation means (150), the conjuring data storage unit (125) of the central control means (110) has a speech data storage area (126), and when the operation unit (116) determines specific feature information and changes for display part of the line image displayed on the display means (135), the main control unit (112) may read out speech data which enables the contents of the specified information to be expressed by speech from the speech data storage area (126) and cause the speech generation means (150) to output the contents of the specified information by speech.

Furthermore, the conjuring data storage unit (125) stores as feature information speech data, graphic design data and/or character data on four suit markers and numbers one to thirteen which are provided on playing cards used as a conjuring tool, the main control unit (112) causes the display means (135) to display 12 dots disposed in a circle less conspicuously, and the operation unit (116) determines specific feature information based on a drawing order of a circular line drawn in the vicinity of the position of the dots and a plurality of lines drawn within the circular line, and when specific feature information is determined, the main control unit (112) may cause the image data forming and outputting unit (118) to change among lines drawn at least a lower line which is drawn within the circle.

In addition, the operation unit (116) determines specific feature information based on a drawing order of a predetermined diagram such as a rectangle, and when the specific feature information is determined, the main control unit (112) may pick up feature information on a specified conjuring tool from the conjuring data storage unit (125) and cause the image data forming and outputting unit (118) to display the feature of the specified conjuring tool within a frame of a diagram such as a rectangle in the form of an image or text.

In addition, the central control means (110) includes in the conjuring data storage unit (125) a graphic design data storage area (127) which stores picture designs of conjuring tools as feature information, and the graphic design data storage area (127) stores therein picture design data of the playing cards and face image data of each playing card as feature information, the operation unit (116) determines a specific playing card based on a drawing order of a diagram drawn into a rectangle or determines a specific playing card by a marker and a number which are drawn inside a rectangle after the rectangle has been drawn by a diagram, and when a specific playing card is determined, the main control unit (112) may cause the image data forming and outputting unit (118) to display a picture design on a back side of the playing card within the frame of the diagram and turn the specific playing card to display a face side thereof or add an image on the face side of the specific playing card to the line images of the rectangle, the marker and the number which were so drawn.

In the conjuring assisting toy according to the present invention which is configured as has been described heretofore, when a desired picture made up of lines is inputted as by drawing lines by designating coordinates relative to the display area of the display means by using the coordinate inputting means, a diagram that is inputted into the display means is displayed in association with the input of the picture, and the results of a conjuring trick are displayed by changing the diagram so displayed, whereby the supernatural force and interestedness which are inherent in a conjuring trick can be given to the viewer.

In addition, when displaying the results of a conjuring trick, in the event that speech is generated by the speech generation means, the viewer is allowed to feel interestedness by being made to feel as if the toy spoke or the results of the conjuring trick were announced by the picture drawn. In addition, in the toy in which the information on the four suit markers and the numbers from one to thirteen of the playing cards is stored in the conjuring data storage unit, the toy can be made into a conjuring assisting toy which uses the playing cards which are used in various types of conjuring tricks in many cases.

Furthermore, in the conjuring assisting toy which includes the main control unit which causes the display means to display 12 dots in a circle, the input of a diagram is made extremely easy by making use of the dots, so as to facilitate the provision of interestedness which is inherent in a conjuring trick.

In addition, in the conjuring assisting toy in which the operation unit determines the specific feature information based on the drawing order of the predetermined diagram such as the rectangle, since a conjuring tool can be specified by only drawing a predetermined simple diagram, the input of a diagram can be facilitated.

Furthermore, in the assisting toy in which a specific graphic design of the playing card is made to be displayed inside or outside of the rectangular frame, the viewer can be made to feel the sensation of inevitability in inputting a diagram and to feel strongly the supernatural force inherent in a conjuring trick by the results of a conjuring trick being displayed by the contents of the graphic design displayed.

DESCRIPTION OF THE PREFERRED EMBODIMENTS

Figure 1:
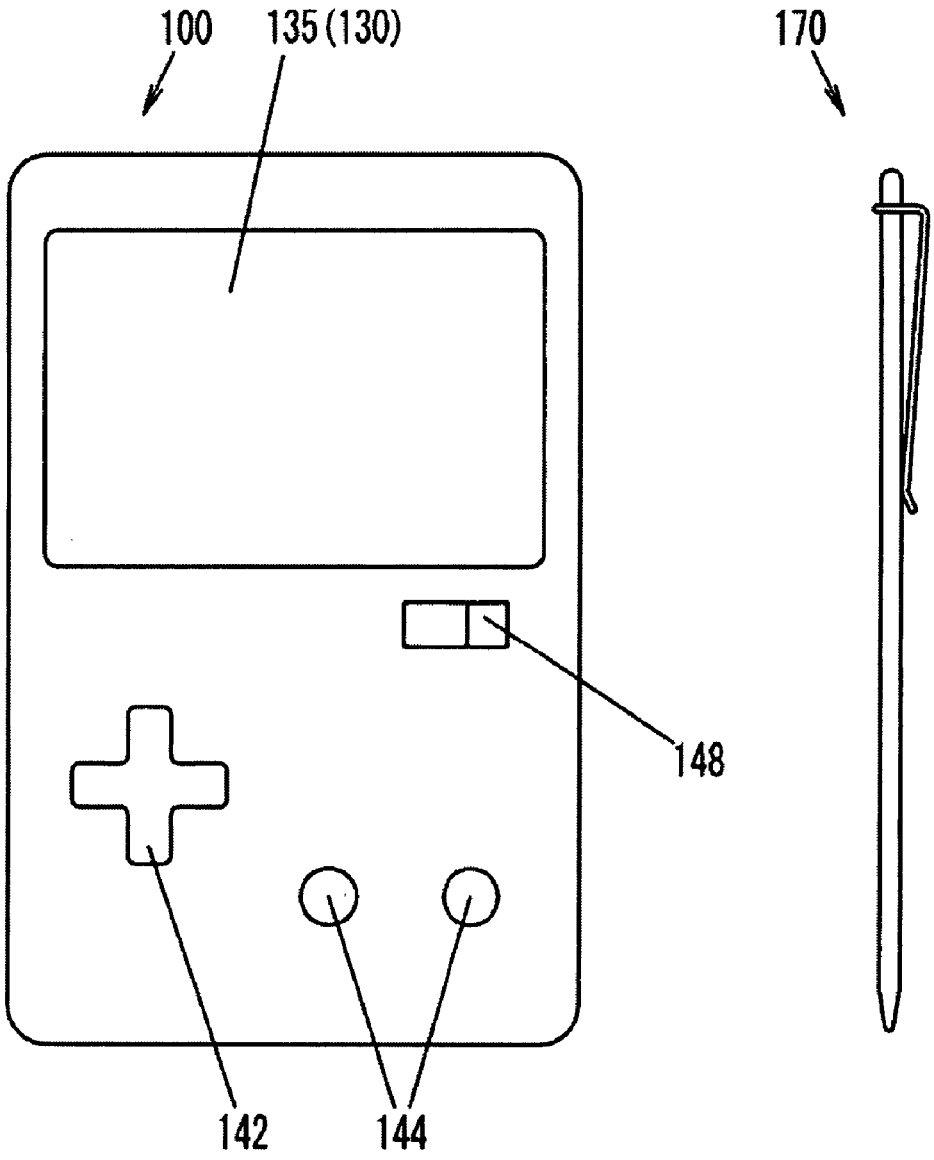
FIG. 1 is a front view showing an example of a conjuring assisting toy according to the invention.

A best mode for carrying out a conjuring assisting toy 100 according to the present invention has a display means 135 for displaying an image, a switch control unit 140 as an input means which has switches and a touch panel 130 as a coordinate inputting means which is superposed on the display means 135, a central control means 110 and a speech generation means 150, and the central control means 110 includes a main control unit 112, a conjuring data storage unit 125, an input analyzing unit 114 and an operation unit 116, an operation result storage unit 122, an inputted diagram storage unit 120 and an mage data forming and outputting unit 118.

In addition, the conjuring data storage unit 125 is such as to store feature information on conjuring tools, the input analyzing unit 114 is such as to analyze a control signal from the switch control unit 140 and an inputted position signal from the touch panel 130, and the main control unit 112 is such as to cause position information based on the inputted position signal which is sent from the input analyzing unit 114 to be stored in the inputted diagram storage unit 120, cause a line image inputted into the display means 135 by causing diagram data to be outputted from the image data forming and outputting unit 118 based on the position information to be displayed, and cause part or the whole of the line image displayed on the display means 135 by the image data forming and outputting unit 118 to be changed so as to display a time-varying image when the operation unit 116 determines specific feature information from the information stored in the conjuring data storage unit 125.

Note that the main control unit 112 is also such as to control various games by control signals from the switch control unit 140.

In addition, the operation unit 116 is such as to select and determine specific feature information from the conjuring data storage unit 125 based on a drawing order of an input diagram and an input starting position of the diagram that is to be inputted into the touch panel 130, and the central control means 110 has a speech data storage area 126 in the conjuring data storage unit 125. When changing part of the line image displayed on the display means 135 in association with the operation unit 116 determining specific feature information, the main control unit 112 reads out from the speech data storage area 126 data which allows the specified contents of the specified feature information to be expressed by speech and causes the speech generation means 150 to output the specified contents by speech.

Then, the conjuring data storage unit 125 has, in addition to the speech data storage area 126, a graphic design data storage area 127 and a character data storage area 128, so that speech data, graphic design data and/or character data of four suit markers and numbers from one to thirteen of playing cards used are allowed to be stored as feature information.

Furthermore, the main control unit 112 causes the display means 135 to display 12 dots which are disposed in a circle less conspicuously, the operation unit 116 determines specific feature information based on a drawing order of a circular line which is drawn in the vicinity of the position of the dots or a plurality of lines drawn within the circular line and an input starting position, and furthermore, when specific feature information is determined, the main control unit 112 causes a lower line which is drawn within the circle by the image data forming and outputting unit 118 to be changed.

In addition, the operation unit 116 determines specific feature information based on a drawing order of a diagram which is drawn into a rectangle, the conjuring data storage unit 125 includes the graphic design storage area 127 which stores picture designs of conjuring tools as feature information, and when specific feature information is determined and feature information which represents a feature of a specified conjuring tool is selected from the conjuring data storage unit 125 so as to display an image within the frame of the rectangular diagram, the main control unit 112 may causes the image data forming and outputting unit 118 to display a graphic design based on the feature information so selected from the graphic design data storage area 127.

In addition, the conjuring data storage unit 125 stores a picture design on the backs of the playing cards and graphic designs on the faces of the 52 playing cards which are used as feature information, the operation unit 116 determines a specific playing card based on a drawing order of a rectangle which is the drawing order of the diagram which is drawn into the rectangle and a marker or number which is drawn within the rectangle after the rectangle has been drawn, and when the specific playing card is so determined, the main control unit 112 may causes the image data forming and outputting unit 118 to display the picture design on the back of the playing card within the frame of the diagram and then causes the specific playing card to turn to shown the face thereof or cause a line to be added within the frame where a marker and a number are drawn, so as to display the face of the specific playing card.

Hereinafter, the invention will be described in detail using the accompanying drawings.

An embodiment of a conjuring assisting toy 100 according to the present invention is a game machine which has, as is shown in FIG. 1, a display means 135 made up, for example, of a liquid crystal panel above a main switch 148, as well as a switch control unit which includes a cross key 142 and button switches 144, and a touch panel 130, which functions as a coordinate inputting means, is provided on a surface of the liquid crystal panel, which is the display means 135. A touch pen 170, which is formed from resin into a rod-like element, is provided as an accessory.

This conjuring assisting toy 100 incorporates a microcomputer so that various games can be played thereon and allows part of a conjuring trick using playing cards to be produced by selecting one of icons which represent conjuring trick games using playing cards which are displayed on a menu screen with the touch pen 170 or scrolling a display list with the cross key 142 for selection by the button switch 144.

Figure 2:
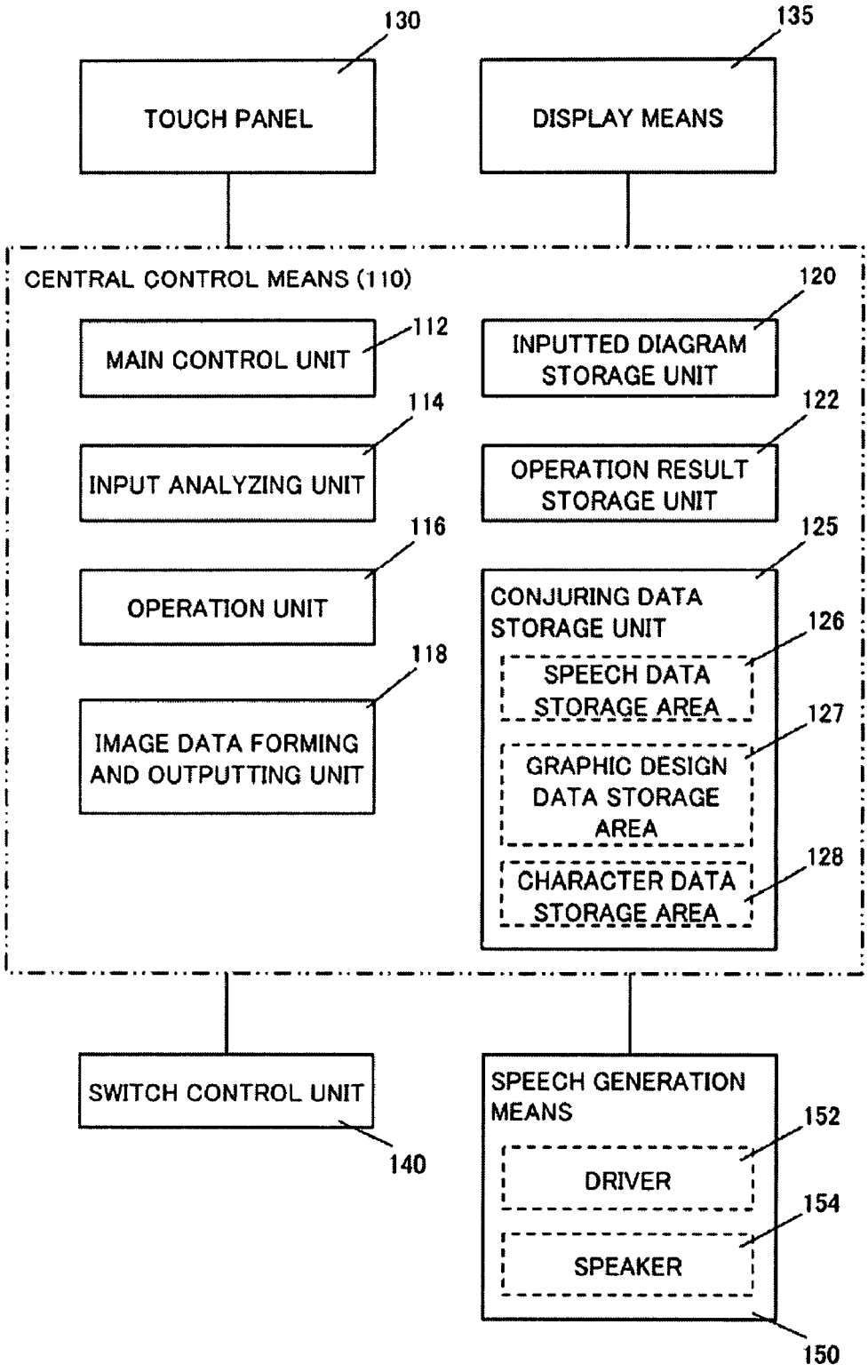
FIG. 2 is a block diagram showing an example of the configuration of the conjuring assisting toy according to the invention.

This conjuring assisting toy 100 incorporates a central control means 110 which is made up of the microcomputer and memories such as RAM and ROM, and as is shown in FIG. 2, a main control unit 112, an input analyzing unit 114, an operation unit 116, an inputted diagram storage unit 120, an operation result storage unit 122, a conjuring data storage unit 125 and an image data forming and outputting unit 118 are provided in the central control means 110.

Then, an image such as a diagram or a picture design is displayed on the display means 135 based on an input signal such as a control signal produced via the touch panel 130 or by operating the switch in the switch control unit 140, so as to switch between games or make a selected game to progress or speech can be produced from a speaker 154 of a speech generation means 150 via a driver 152 based on speech data from the central control means 110 as required.

Note that a part of memories such as ROM may be detachable.

In addition, the conjuring data storage unit 125 has provided therein a speech data storage area 126, a graphic design data storage area 127 and a character data storage area 128, so that graphic design, character and speech data of each of conjuring trick cards such as playing cards and other various types of cards which function as conjuring tools which are used together with the conjuring assisting toy 100 are stored as feature information in the conjuring data storage unit 125.

Additionally, in the conjuring assisting toy 100 which is adapted to be used together with conjuring trick playing cards, speech data on words corresponding to the four suit markers of the playing cards such as "diamond," "club," "heart," and "spade," words for numbers "2" to "10," words corresponding to numbers "1" and "11" to "13" of the playing cards such as "ace," "Jack," "Queen," and "King" and appropriate conjunctions and adverbs is stored as feature information in the speed data storage area 126, data on a graphic design on the backs of the playing cards used for conjuring tricks and graphic designs on the faces of the respective 52 playing cards is stored as feature information in the graphic design data storage area 127, and character data for use in displaying the marker and the number on each card on the display means 135 is stored as feature information in the character data storage area 128.

In addition, the conjuring trick playing cards, which are used when conjuring a trick on the conjuring assisting toy 100, look the same on their backs, but hidden markers are provided on the backs thereof with which the conjuror can read the four suit markers and numbers from one to thirteen which are drawn on the faces of the respective playing cards, so that the conjuror can see the suit marker such as diamond, club, heart and the like and the number which are given to the face of the playing card which is selected by one of the audience, and the conjuror can produced a certain dramatic effect using the conjuring assisting toy 100 when announcing the suit marker and the number on the face of the playing card which is turned to show its back.

Figure 3:
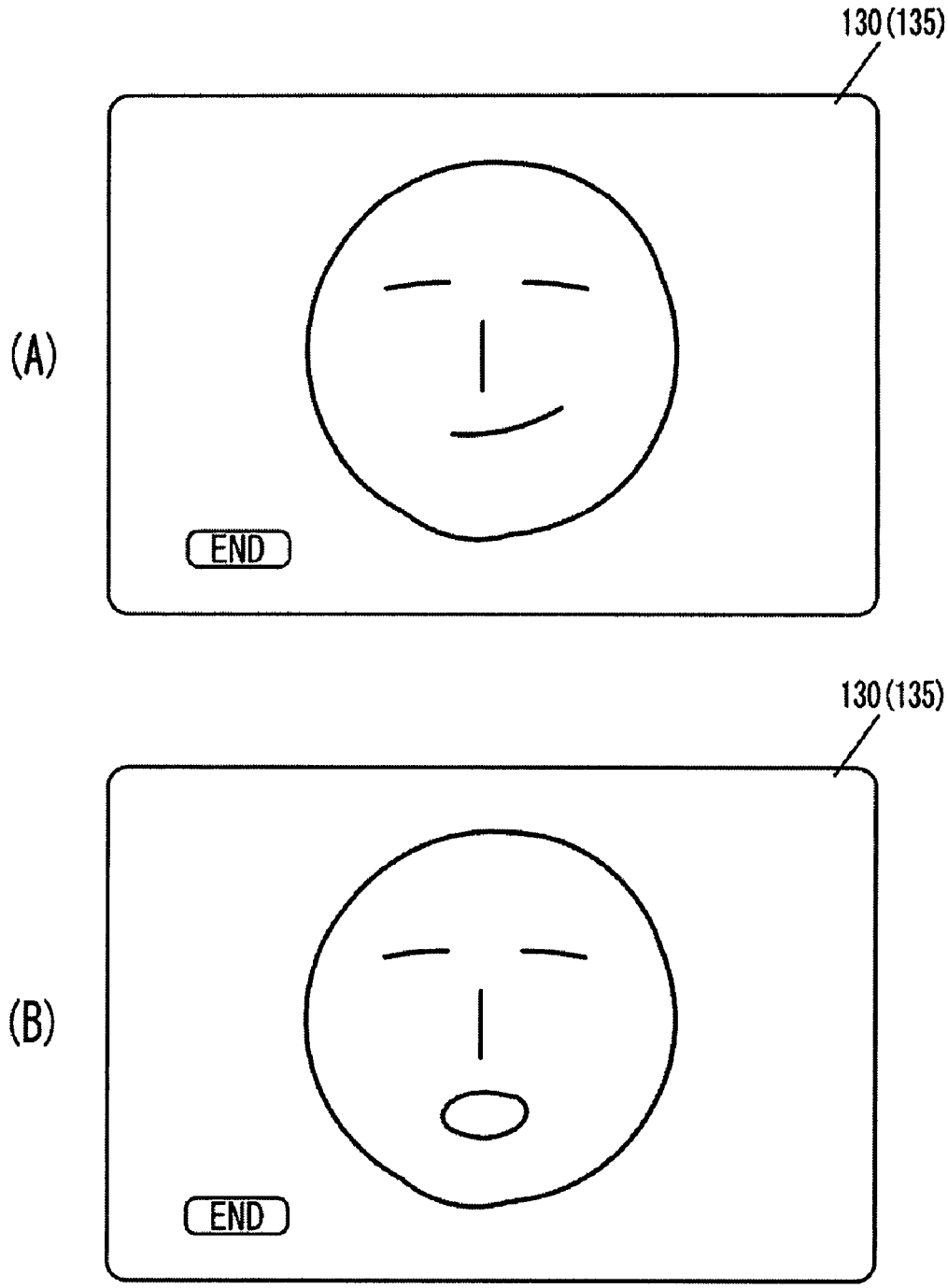
FIG. 3 shows drawings which illustrate display examples by a display means of a first embodiment of a conjuring assisting toy according to the invention.

Namely, in the first embodiment, as is shown in FIG. 3A, the face of a human being drawn with the touch pen 170 is displayed on the display means 135 by drawing a circle and four lines within the circle on the display means 135 with the touch pen 170, and the line illustrating the mouth is changed as is shown in FIG. 3B, so as to produce a dramatic effect in guessing right the playing card selected by the playing partner which is one of the audience by producing speech as announcing, "I guess it is the King of the Diamond."

Figure 4:
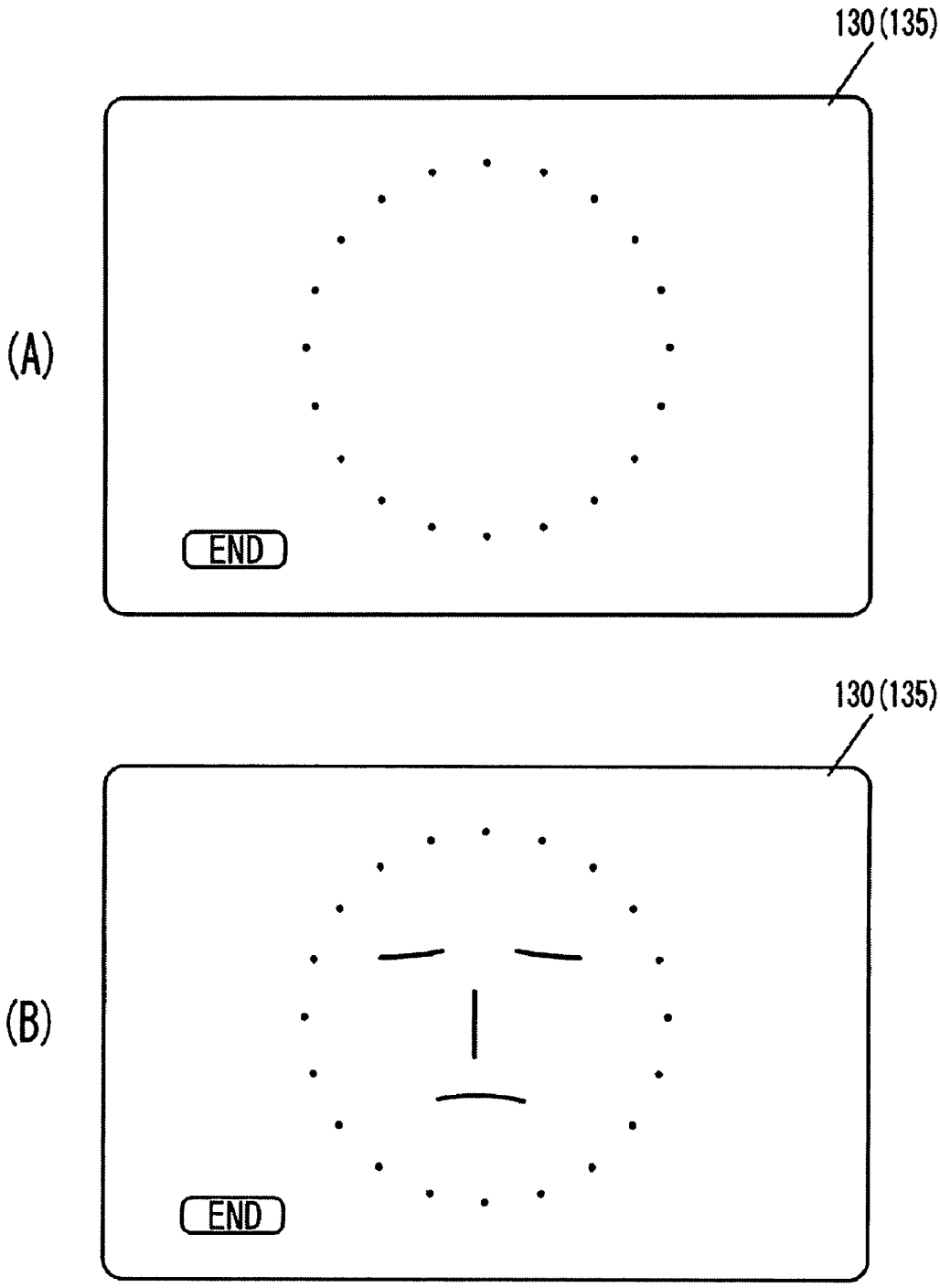
FIG. 4 shows drawings which illustrate display examples by the display means of the first embodiment of the conjuring assisting toy according to the invention.
Figure 12:
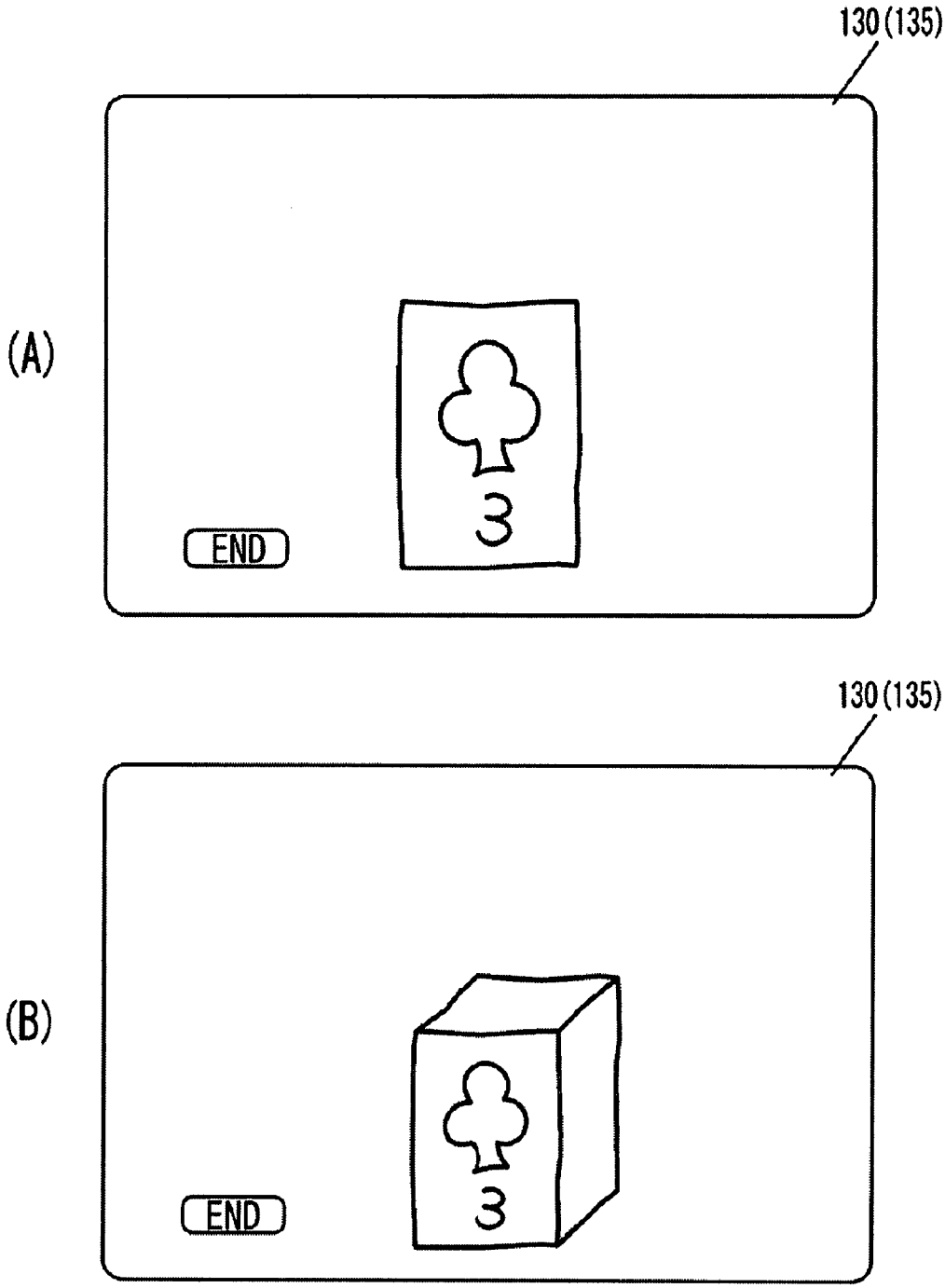
FIG. 12 shows drawings showing display examples by a display means of a third embodiment of a conjuring assisting toy according to the invention.

In addition, as is shown in FIG. 4A, 12 dots, which constitute indication pointers in drawing a circle which forms a contour of the face, are displayed less conspicuously on the display means 35 on which lines are drawn to draw the face, and four lines are drawn inside the 12 dots which are disposed in the circle so as to form the respective portions of the face (refer to FIG. 4B), whereby anybody can easily draw the lines which represent the face on the display means 135.

Figure 5:
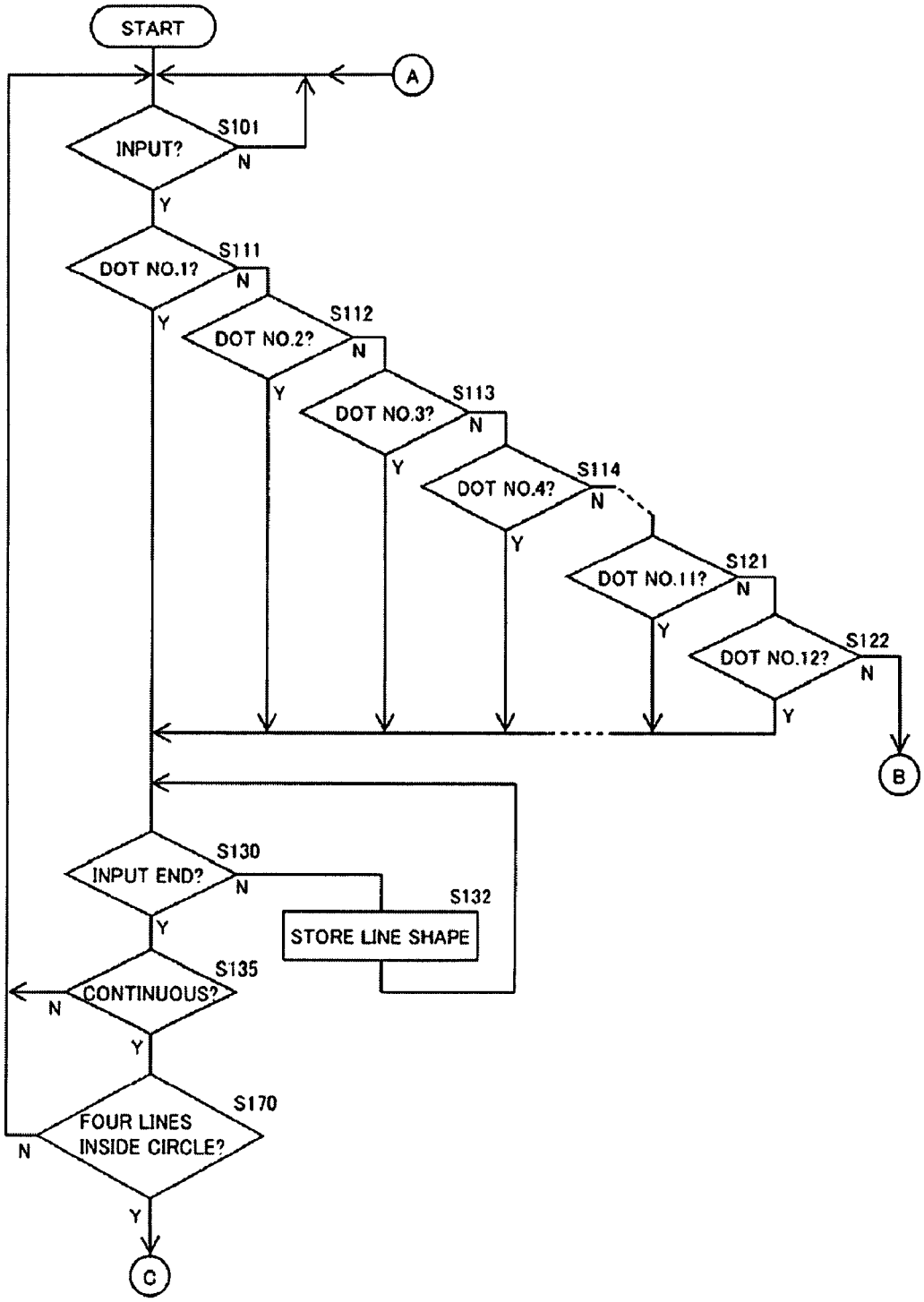
FIG. 5 is a flowchart illustrating a control operation of the first embodiment of the conjuring assisting toy according to the invention.

In processing an input signal in the conjuring assisting toy 100 when drawing the diagram of the face, as is shown in FIG. 5, whether or not an input into the touch panel 130 has been performed is determined by the main control unit 112 (S101), and when the input into the touch panel 130 with the touch pen 170 is started, the input analyzing unit 114 determines an input position, and position information based on the input position signal sent from the touch panel 130 is caused to be stored in the inputted diagram storage unit 120, the image data forming and outputting unit 118 being caused to output diagram data therefrom based on the position information recorded in the inputted diagram storage unit 120 to the display means 135 so as to display a dot or a line in the input position by the touch pen 170.

Then, the main control unit 112 determines based on the position information which has resulted from analyzing the input position signal in the input analyzing unit 114 whether or not a first input position lies in an area near the first dot among the 12 dots which are disposed in the circle (S111), then determines whether or not the first input position lies in an area near the second dot (S112), further determines whether or not the first input position lies in an area near the third dot (S113), and continues to make determinations sequentially in this way until it determines whether or not the first input position lies in an area near the twelfth dot (S122).

Note that the 12 dots are arranged in a similar way in which the scales on a clock are arranged, and the upper central dot is made to be the twelfth dot, so that the dots are sequentially made to be the first dot to the twelfth dot in the clockwise direction.

Figure 6:
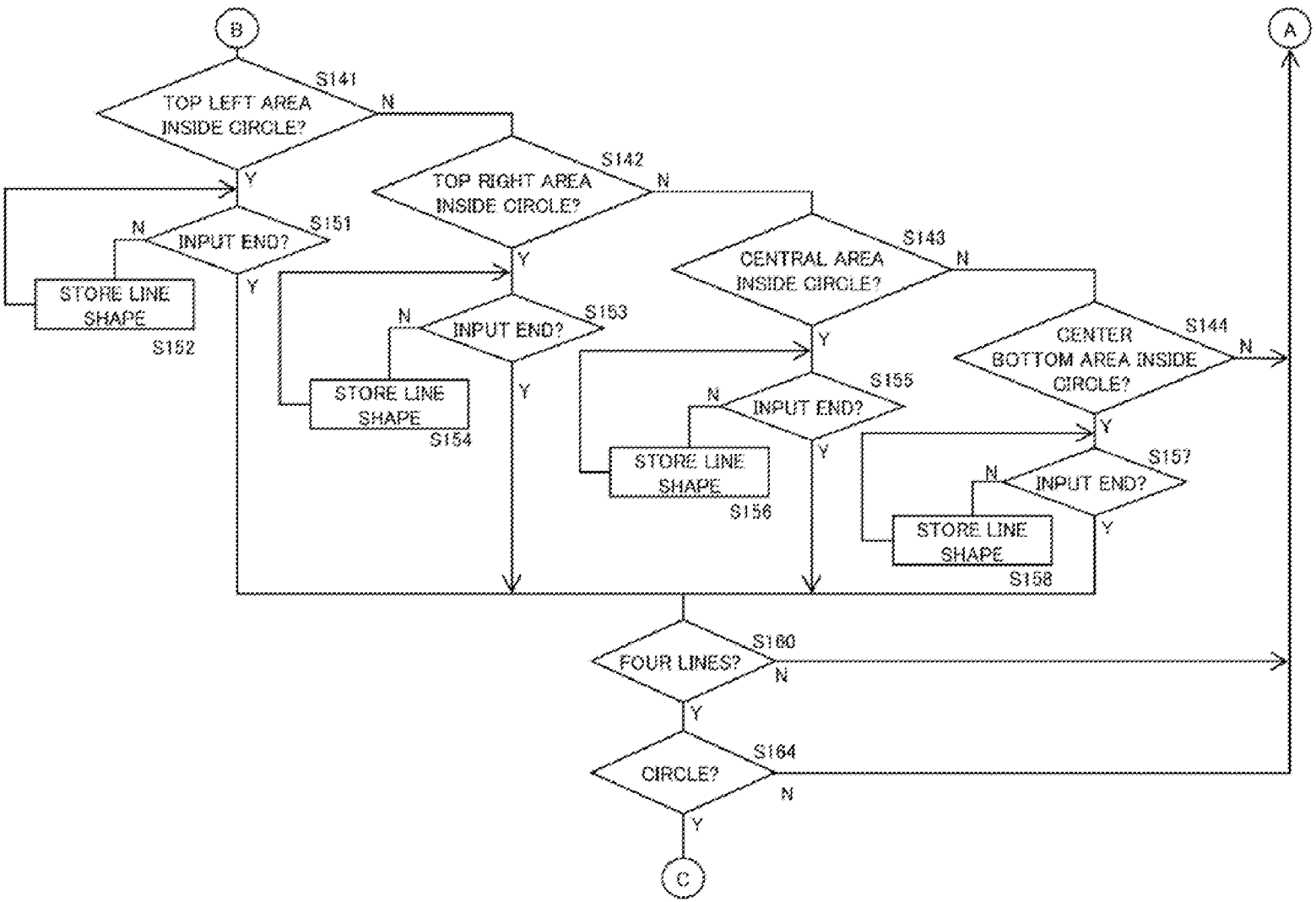
FIG. 6 is a flowchart illustrating the control operation of the first embodiment of the conjuring assisting toy according to the invention.

In addition, if the first input position does not lie in an area near any of the 12 dots which are disposed in the circle, as is shown in FIG. 6, the main control unit 112 determines whether or not the first input position lies in a top left area inside the circle (S141), then determines whether or not the first input position lies in a top right area inside the circle (S142), further determines whether or not the first input position lies in a central area in the circle (S143) and then determines whether or not the first input position lies in a center bottom area within the circle (S144).

In addition, when the input is made in an area near any of the 112 dots, the main control unit 112 determines whether or not the input has been completed, that is, whether or not the touch pen 170 has been put apart from the touch panel 130 (S130), the main control unit 112 causes the input analyzing unit 114 to analyze an inputted moving position of the touch pen 170, causes the inputted diagram storage unit 120 to store inputted position information (S132) and causes the image data forming and outputting unit 118 to display the movement of the touch pen 170 on the display means 135, so as to display a moving locus of the touch pen 170 on the display means 135.

Furthermore, when the input is determined to have been made in an area near any of the 12 dots, if the input is determined to have been made as a result of the determination of whether or not the input has been completed (S130), the main control unit 112 further makes a determination of whether or not a line drawn looks like a continuous line, which determination constitutes a determination of whether or not a starting point and a terminating point of the line drawn are close to each other within a predetermined interval (S135). Then, if the circular line is not continuous, the operation flow returns to the determination of whether or not an input to the touch panel 130 has been made, that is, whether or not there has been an input (S101). On the contrary, if the line is continuous, the main control unit 112 determines whether or not four independent bar lines have been drawn within the circle (S170), and if four bar lines do not exist within the circle, the operation flow also returns to the determination of whether there has been an input (S101). Thus, the operation flow is made to return to the determination of whether there has been an input (3101) until four bar lines and a circle are drawn as is shown in FIG. 3A. In contrast, if four bar lines have already existed when a circle is drawn, the input analyzing operation is ended, so as to perform a specific data determination operation shown in FIG. 7.

In addition, if the input position on the touch panel 130 where the input is made does not lie in an area near any of the 12 dots but the input is made as by drawing a line in an area within the circle, as has been described before, the main control unit 112 determines whether or not the input position lies in an area near the first dot (S111), then determines whether or not the input position lies in an area near the second dot (S112), and continues to make determinations sequentially in this way until it determines whether or not the input position lies in an area near the twelfth dot (S122), and thereafter, as is shown in FIG. 6, the main control unit 112 determines whether or not the input position lies in a top left area inside the circle (S141), and if the input position lies in the top left area inside the circle, while determining whether or not the input has been completed, that is, whether or not the touch pen 170 has been put apart from the touch panel 130 (S151), the main control unit 112 causes the input analyzing unit 114 to analyze an inputted moving position of the touch pen 170, causes the inputted diagram storage unit 120 to store inputted position information (S152) and causes the image data forming and outputting unit 118 to display the movement of the touch pen 170 on the display means 135, so as to display a moving locus of the touch pen 170 on the display means 135.

In contrast, if the input position does not lie in the top left area inside the circle, the main control unit 112 determines whether or not the input position lies in a top right area inside the circle (S142), and if the input position lies in the top right area inside the circle, while determining whether or not the input has been completed, that is, whether or not the touch pen 170 has been put apart from the touch panel 130 (S153), the main control unit 112 causes the input analyzing unit 114 to analyze an inputted moving position of the touch pen 170, causes the inputted diagram storage unit 120 to store inputted position information (3154) and causes the image data forming and outputting unit 118 to display the movement of the touch pen 170 on the display means 135, so as to display a moving locus of the touch pen 170 on the display means 135.

Furthermore, if the input position does not lie in the top right area, either, the main control unit 112 determines whether or not the input position lies in a central area inside the circle (S143) and determines whether or not the input position lies in a center bottom area inside the circle (S144), and if the input position lies in the central area inside the circle or the center bottom area inside the circle as well, while determining whether or not the input has been completed, that is, whether or not the touch pen 170 has been put apart from the touch panel 130 (S155, S157), the main control unit 112 causes the input analyzing unit 114 to analyze an inputted moving position of the touch pen 170, causes the inputted diagram storage unit 120 to store inputted position information (S156, S158) and causes the image data forming and outputting unit 118 to display the movement of the touch pen 170 on the display means 135, so as to display a moving locus of the touch pen 170 on the display means 135.

Then, in the determinations made on the respective areas, when the input of the line inside the circle is determined to have been ended as a result of the determinations of whether or not the respective inputs have been ended (S151, S153, S155, S157), the main control unit 112 determines whether or not four bar lines have already been drawn in areas inside the circle (S160). If the bar lines so drawn is not four, the operation flow returns to the determination of whether or not there has been an input (S101), whereas if four bar lines exist, the main control unit 112 determines whether or not a circle has already been drawn (S164), and even if no circle has been drawn, the operation flow returns to the determination of whether or not there has been an input (S101). Thus, the operation flow is made to return to the determination of whether there has been an input (S101) until four bar lines and a circle are drawn as is shown in FIG. 3A. In contrast, if a circular line has already been drawn when four bar lines are drawn, the input analyzing operation is ended, so as to perform the specific data determination operation shown in FIG. 7.

Note that although the load relative to the processing capability of the microcomputer is increased, it is possible to implement an input analysis over the whole area of the touch panel 130 so as to analyze the circle and the four lines within the circle without displaying the 12 dots.

Then, after the circle and the four lines inside the circle have been inputted, the main control unit 112 causes the operation unit 116 to analyze and operate the position information which is the diagram data recorded in the inputted diagram storage unit 120 so as to analyze the drawing order of each line, whereby a specific data determination operation is performed in which information of a specific card is selected and specified from the information of each card stored in the conjuring data storage unit 125.

Figure 7:
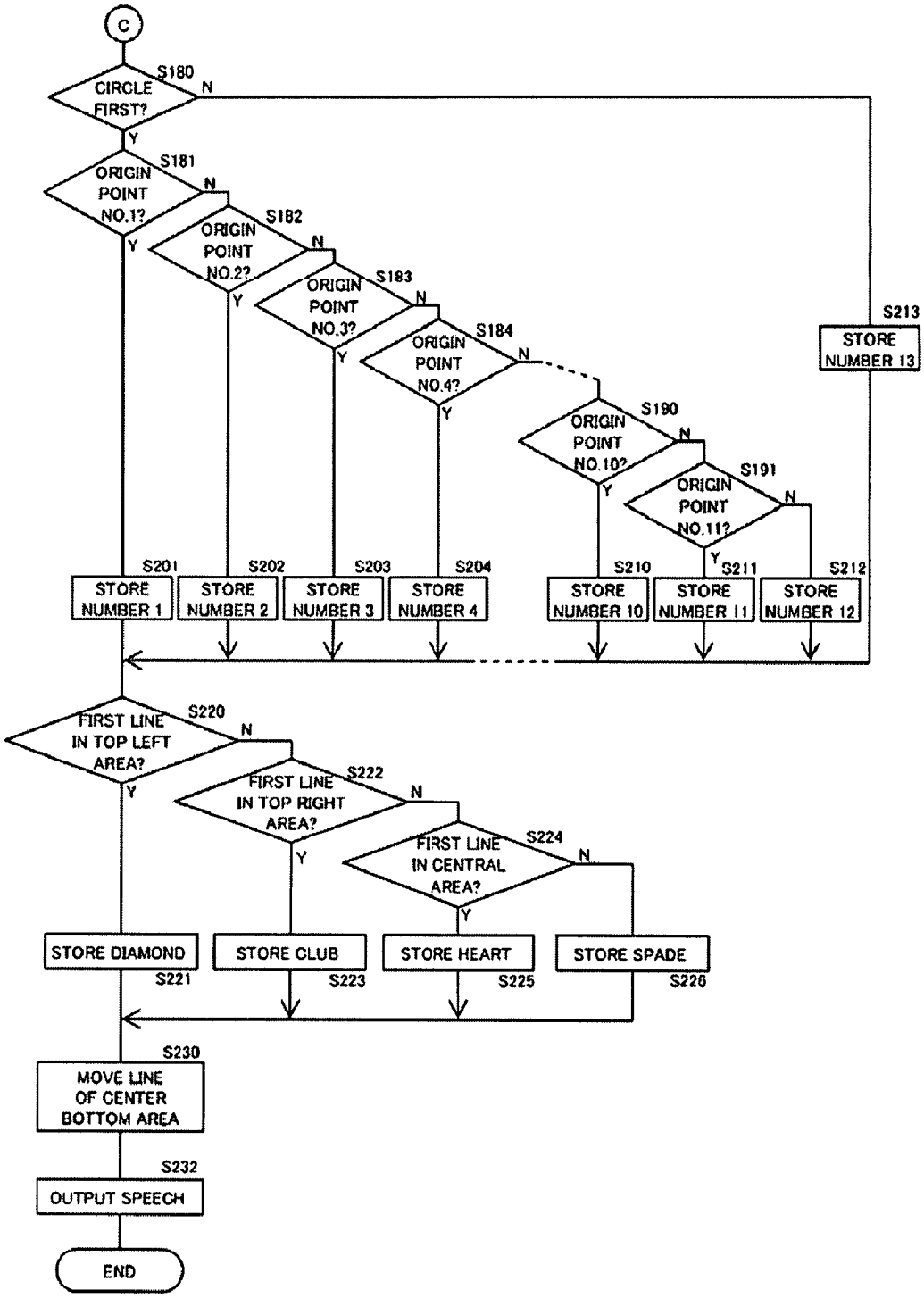
FIG. 7 is a flowchart illustrating the control operation of the first embodiment of the conjuring assisting toy according to the invention.

As is shown in FIG. 7, in this specific data determination operation, whether or not a circle has been first drawn is determined (S180), and if the line first drawn is not a circle, a number 13 is recorded in the operation result storage unit 122 (S213), whereas if the line first drawn is a circle, a determination of an origin point number 1 is made which determination is a determination of whether or not the origin point of the circle lies in an area near the first dot (S181). If the origin point which is an input starting position lies in the area near the first dot, a number 1 is recorded in the operation result storage unit 122 (S201), whereas if the origin point does not lie in an area near the first dot, a determination of an origin point number 2 is made which determination is a determination of whether or not the origin point lies in an area near the second dot (S182). If the origin point lies in the area near the second dot, a number 2 is recorded in the operation result storage unit 122 (S202), whereas if the origin point does not lie in an area near the second dot, either, a determination of an origin point number 3 is made which determination is a determination of whether or not the origin point lies in an area near the third dot (S183). If the origin point lies in the area near the third dot, a number 3 is recorded in the operation result storage unit 122 (S203).

Furthermore, determinations of origin point numbers are made sequentially which are determinations of whether or not the origin point lies in an area near the fourth dot and whether or not the origin point lies in an area near the fifth dot until a determination of an origin point number 11 is completed (S184 to S191), and numbers representing the origin point numbers which are the input starting position determined as the origin point of the circle are recorded in the operation result storage unit 122 (S204 to S211), and if the origin point does not correspond to any of the areas near the first dot to the eleventh dot, a number 12 is recorded in the operation result storage unit 122 (S212).

In this way, after the numbers 1 to 13 have been recorded in the operation result storage unit 122 by the operation unit 116, the drawing order of the four bar lines inside the circle is determined. When a determination of whether or not the bar line drawn initially lies in the top left area inside the circle (S220) determines that the initial bar line lies in the top left area, the diamond is recorded in the operation result storage unit 122 (S221). If the initial bar line is determined not to lie in the top left area, then when a determination of whether or not the initial bar line lies in the top right area inside the circle (S222) determines that the initial bar line lies in the top right area, the club is recorded in the operation result storage unit 122 (S223). If the initial bar line is determined not to lie in the top right area, either, when a determination of whether or not the initial bar line lies in the central area inside the circle (S224) determines that the initial bar line lies in the central area, the heart is recorded in the operation result storage area 122 (S225). If the initial bar line is determined not to lie in the central area, either, then the spade is recorded in the operation result storage unit 122 (S226).

In this way, after the four suit markers such as diamond, club, heart and spade and the numbers 1 to 13 are determined by the operation unit 116 so as to be recorded in the operation result storage unit 122, the main control unit performs an operation (S226) for moving the bar line lying in the center bottom area in such a manner that the bar line lying in the center bottom area inside the circle is caused to be deformed into a circle for display as is shown in FIG. 3B or the deformed bar line is caused to be restored to the original state as is shown in FIG. 3A and reads out from the speech data storage area 126 of the conjuring data storage unit 125 specific speech data which corresponds to the suit markers and the numbers which are recorded in the operation result storage unit 122, causing the speed generation means 150 to generate speech saying such as "I guess it is the king of the diamond" or "I wonder if it is three of the spade."

In addition to the case where specific speech data of the feature information is read out from the speech data storage area 126 so that the speech so read out is generated from the speech generation means 150, there may occur a case where character data which represents a specific marker and number is picked up from the character data storage area 128 based on the markers and numbers of the playing cards recorded in the operation result storage unit 122, the image data forming and outputting unit 118 forms display data for displaying the marker and the number which are specified based on the feature information so picked up in a graphic design of a balloon and outputs the display data so formed to the display means 135, so as to change the display on the display means in such a manner that words are additionally written to the picture of the face displayed on the display means 135 or a case where card face graphic design data for a specified card is read out from the graphic design data storage area 127 based on the markers and the numbers of the playing card recorded in the operation result storage unit 122, so that a displayed image is changed in such a manner that the card face graphic design data so read out is added to a picture displayed as appropriate image data by the image data forming and outputting unit 118.

In this way, in the conjuring assisting toy 100, in case that a playing card conjuring trick using the conjuring playing cards is produced, when a person who is playing a role of the conjuror locates a card arbitrarily selected by a playing partner who is one of the audience from the design on the back thereof, in the event that a picture of the face is drawn by lines on the display means 135 of the conjuring assisting toy 100, a dramatic effect is produced in which the face drawn guesses right the card selected by the playing partner which only the playing partner knows of so as to give a surprise to the audience including the playing partner, thereby making it possible to produce an interesting conjuring trick easily.

Figure 8:
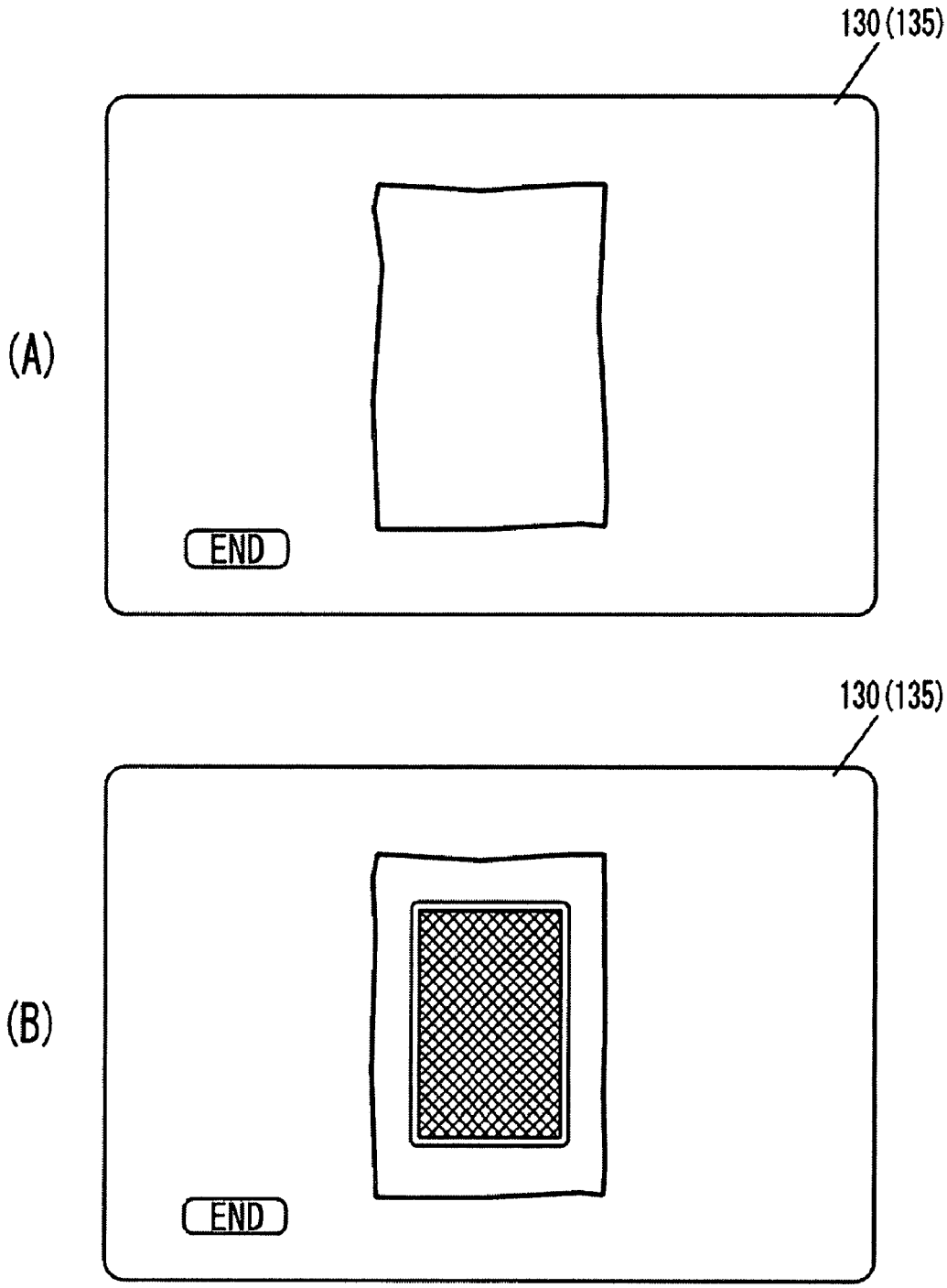
FIG. 8 shows drawings showing display examples by a display means of a second embodiment of a conjuring assisting toy according to the invention.

In addition, as another embodiment, as is shown in FIG. 8A, when a vertically long rectangle is drawn on a display means 135 with a touch pen 170, the back of a playing card is displayed inside the quadrangular shape as is shown in FIG. 8B. Then, when this card turns, as is shown in FIG. 9A, so that the face of the card is displayed as is shown in FIG. 9B, as this occurs, a wondering trick is produced in which the face of the card so displayed represents that of the card selected by a playing partner which is one of the audience who only knows of the selected card.

Also in this second embodiment, as with the first embodiment, a main control unit 112 detects an input into a touch panel 130, an input position signal from the touch panel 130 is analyzed in an input analyzing unit 114, position information is recorded in an inputted diagram storage unit 120, an input analyzing operation is performed while displaying inputted lines on the display means 135 by diagram data from an image data forming and outputting unit 118 based on the inputted position information so recorded, and when a rectangle is drawn, a specific data determination operation based on a drawn order of respective sides of the rectangle is performed.

Figure 10:
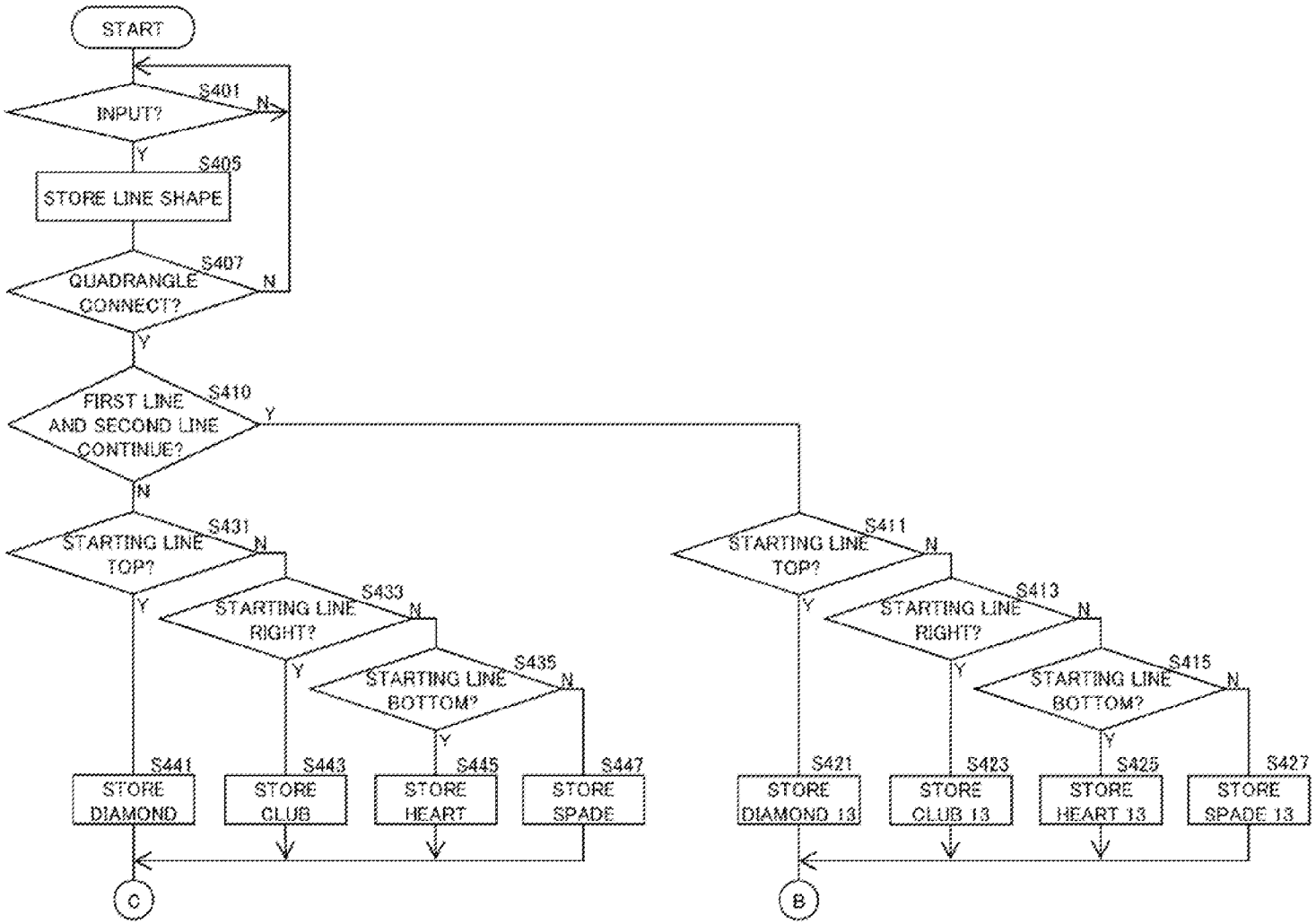
FIG. 10 is a flowchart illustrating a control operation of the second embodiment of the conjuring assisting toy according to the invention.
Figure 11:
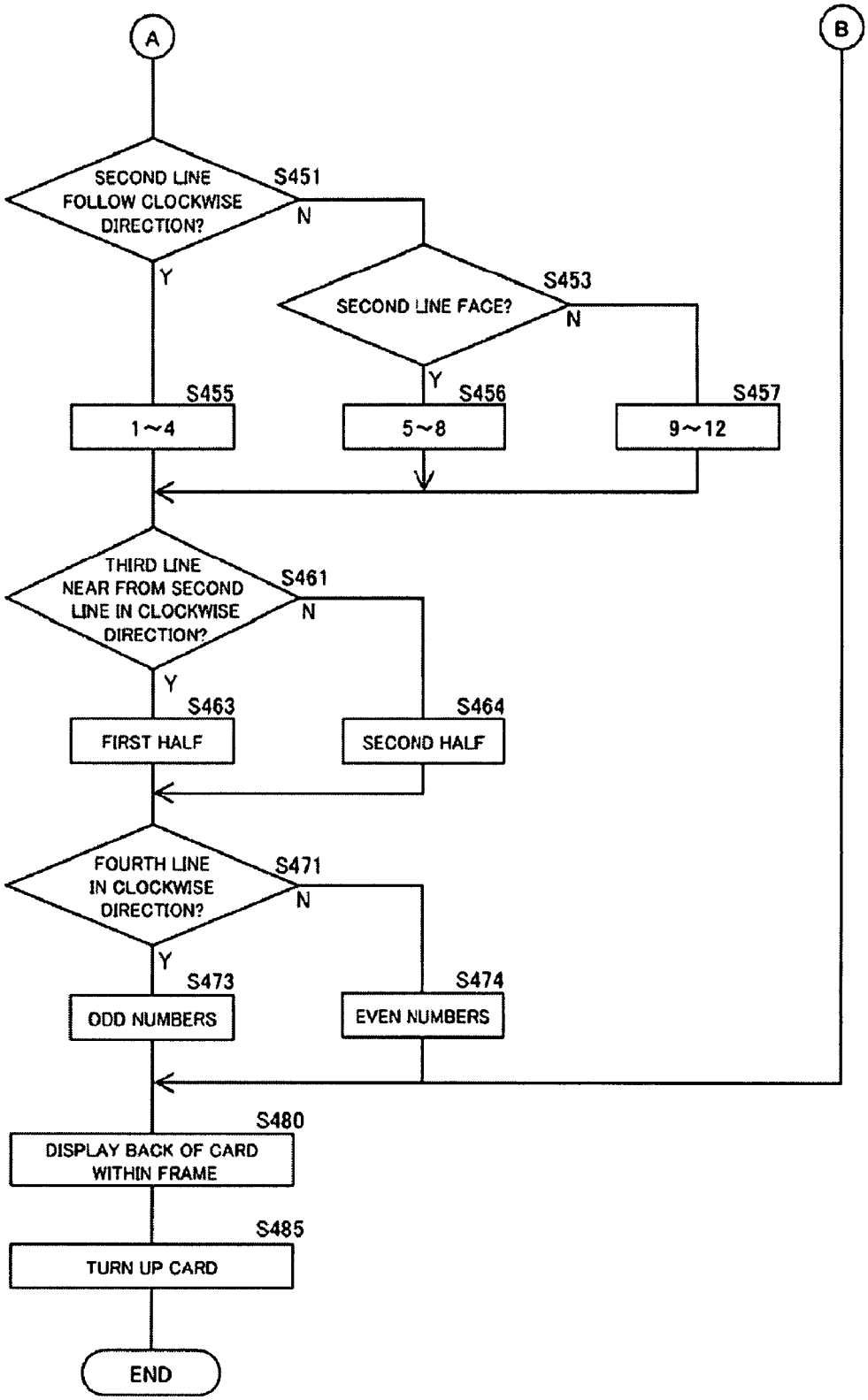
FIG. 11 is a flowchart illustrating the control operation of the second embodiment of the conjuring assisting toy according to the invention.

In these input analyzing operation and the specific data determination operation, as is shown in FIGS. 10 and 11, firstly, the main control unit 112 makes a determination of whether or not there has been an input which is a determination of whether or not an input into the touch panel 130 has been made (S401) When an input into the touch panel 130 with a touch pen 170 is started, the input position is analyzed by the input analyzing unit 114, so that position information is caused to be stored in the inputted diagram storage unit 120 (S405), and diagram data is outputted from the image data forming and outputting unit 118 to the display means 135 based on the position information recorded in the inputted diagram storage unit 120, so that dots and lines are displayed in input positions where inputs with the touch pen 170 are performed. This series of operations is similar to that of the embodiment 1, and when the touch pen 170 is put apart from the touch panel 130 and no input is made from the touch panel 130, whether or not a line that is completed to be drawn is connected or formed into a quadrangle is determined by determining whether or not a starting point and a terminating portion of the line so drawn is closed to each other or whether or not a line written to be added to a line that has already been drawn constitutes a substantially continuous line (S407).

In addition, if the line drawn is determined not to be the connected quadrangle, the operation flow returns to the determination of whether or not there has been an input (S401), and when an input into the touch panel 130 is made, input position information is caused to be stored in the inputted diagram storage unit 120 (S405) and lines inputted are displayed on the display means 135. If no further input is made, whether or not the line is connected into the quadrangle is determined (S407), and when the line is determined to be connected into the quadrangle, the input analyzing operation is ended and the specific data determination operation is started.

The specific data determination operation in this second embodiment is also implemented mainly by the operation unit 116, and in the quadrangle drawn on the display means 135, a determination of whether or not an initial line and a second line forms a continuous line is made initially which is a determination, which is made based on the position information recorded in the inputted diagram storage unit 120, of whether or not after a straight line which constitutes a first side and a straight line which constitutes a second side are drawn in series by a single line or are drawn in such a manner as to be divided in the middle of the two lines, other two lines are drawn to form a quadrangle together with the lines so drawn (S410).

Then, if the line is determined to be continuous, whether or not the input starting line was the upper horizontal line of the quadrangle (S411), whether or not the input starting line was the right vertical line (S413) and whether or not the input starting line was the lower horizontal line (S415) are determined sequentially. If the starting line was the upper horizontal line, the 13 of the diamond is recorded in the operation result storage unit 122 (S421), if the starting line was not the upper horizontal line but the right vertical line, the 13 of the club is recorded in the operation result storage unit 122 (S423), if the starting line was not the right vertical line, either but the lower horizontal line, the 13 of the heart is recorded in the operation result storage unit 122 (S425), and if the starting line was not the upper horizontal line, not the right vertical line, and furthermore not the lower vertical line, the 13 of the spade is recorded in the operation result storage unit 122 (S427).

In addition, when the input of the first line and the second line of the quadrangle drawn on the display means 135 is interrupted in the midst thereof, resulting in the first line and the second line being inputted separately, when a determination of whether or not the initial straight line was the upper horizontal line (S431) determines that the initial straight line was the upper horizontal line, the diamond is recorded in the operation result storage unit 122 (S441). If the initial straight line was not the upper horizontal line, when a determination of whether or not the initial straight line was the right vertical line (S433) determines that the initial straight line was the right vertical line, the club is recorded in the operation result storage unit 122 (S443). If the initial straight line was not the right vertical line, either, when a determination of whether or not the initial straight line was the lower horizontal line (S435) determines that the initial straight line was the lower horizontal line, the heart is recorded in the operation result storage unit 122 (S445). If the initial straight line was not the lower horizontal line, either, then the spade is recorded in the operation result storage unit 122 (S447).

Furthermore, as is shown in FIG. 11, the operation unit 116 determines whether or not the straight line that is inputted second is a straight line which constitutes the side which continues in a clockwise direction or turns rightwards relative to the position of the initial straight line (S451), and if the straight line that is inputted second is the next side which continues in the clockwise direction, the numbers 1 to 4 are recorded in the operation result storage unit 122 (S455), whereas if the straight line is not the next line which so continues, whether or not the straight line that is inputted second is a straight line which constitutes a side which faces the initial straight line is determined (S453). If the straight line is the side which faces the initial straight line, the numbers 5 to 8 are recorded in the operation result storage unit 122 (S456), whereas if the straight line is neither the next side nor the side facing the initial straight line, the numbers 9 to 12 are recorded in the operation result storage unit 122 (S457).

Then, whether or not a third straight line corresponds to, of the two remaining sides of the quadrangle, the side which is nearer in the clockwise direction to the straight line that was drawn second or the side which is farther from the same straight line is determined (S461), and if the side which is nearer to the side drawn second in the clockwise direction which is the right-handed direction was drawn as the third straight line, an operation is performed in which the numbers which are recorded in the operation result storage unit 122 are limited to the first-half numbers (1 or 2, 5 or 6, 9 or 10) (S463), whereas if the straight line drawn third is the side farther from the side drawn second in the clockwise direction which is the right-handed direction, an operation is performed in which the numbers recorded in the operation result storage unit 122 are limited to a second-half numbers (3 or 4, 7 or 8, 11 or 12) (S464).

Furthermore, whether or not the remaining fourth line is a straight line which was drawn in the clockwise direction or a straight line which was drawn in a counterclockwise direction is determined (S471), and if the fourth line is the straight line drawn in the right-handed direction which is the clockwise direction, the numbers recorded in the operation result storage unit 122 are made odd numbers (S473), whereas if fourth line is the straight line drawn in the left-handed direction which is the counterclockwise direction, the numbers recorded in the operation result storage unit 122 are made even numbers (S474).

In this way, in the event that the two sides are drawn continuously when the four sides of the rectangle are drawn, the operation unit 116 causes the kings, which is a number 13, of the respective suits of the playing cards to be recorded in the operation result storage unit 122 based on the position of the starting side, in the event that the first and second sides of the rectangle are drawn in an interrupted fashion, causes the four suit markers of the playing cards to be recorded in the operation result storage unit 122 based on the position of the side which was drawn initially, causes any four numbers of the numbers "1 to 4", "5 to 8," and "9 to 12" to be recorded in the operation result storage unit 122 based on the position of the side drawn second relative to the side drawn first, causes four numbers to be restricted to two numbers depending upon whether or not the side drawn third is closer to the side drawn second in the right-handed direction, and determines whether the number is an odd number or even number so as to restrict the two numbers to one number based on a writing direction of the side drawn fourth, whereby one of the 52 playing cards can be determined by how to draw the simple quadrangle.

Figure 9:
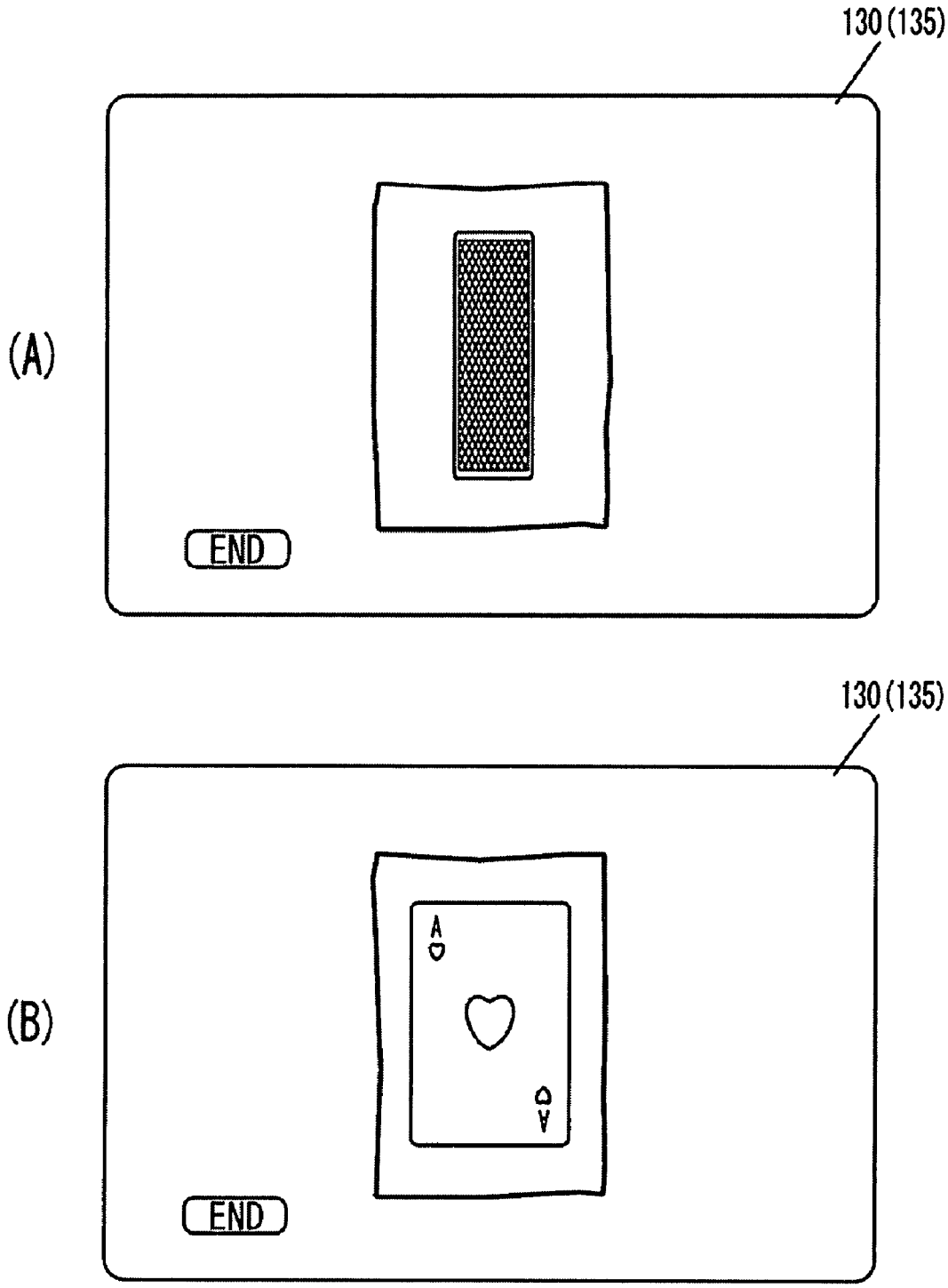
FIG. 9 shows drawings showing display examples by the display means of the second embodiment of the conjuring assisting toy according to the invention.

Then, when the operation unit 116 determines a specific card, the main control unit 112 selects the graphic design data for the back of the card so determined in the feature information from the graphic design data storage area 127 within the conjuring data storage unit 125 and causes the image data forming and outputting unit 118 to convert the graphic design data so selected into display data so as to output the display data so converted to the display means 135, whereby the back of the card is caused to be displayed inside the rectangle drawn on the display means 135 (S480). Then, the main control unit 112 causes the card to turn so as to display the face thereof as is shown in FIG. 9, and when the face of the card is displayed, the main control unit 112 causes a graphic design display based on the feature information to be performed in which the face of the specified card which is specified by the suit marker and the number of the card which are recorded in the operation result storage unit 122 is displayed (S485).

In addition, there may be a case where a dramatic display is implemented in which a person such as a conjuror or clown is caused to be displayed within the frame without displaying the back of a card and the conjuror or clown picks up a specific card which is recorded in the operation result storage unit 122.

Additionally, the shape of the frame in which a playing card is displayed is not limited to the quadrangle but a hexagonal or octagonal frame may be drawn as a display frame on the liquid crystal panel which is the display means 135.

Furthermore, in a conjuring assisting toy 100 as a third embodiment, after one of conjuring playing cards which are turned to show their backs to the audience is picked up by one of the audience or a playing partner, one playing card is shown on a display means 135 of the conjuring assisting toy 100, as is shown in FIG. 12A.

In this case, a person who plays a role of a conjuror draws a card of a suit marker and a number which are different from a suit marker and a number of the card selected by the playing partner which are read by the player from the design on the back of the card. Then, after the player confirms with the playing partner that the card drawn by the player is a card which is separate and differs from the card selected by the playing partner through conversation with him or her, as is shown in FIG. 12B, quadrangles, which are each deformed, are drawn to be adjacent, respectively, to two adjacent sides of a quadrangular card which has been drawn in advance, whereby by drawing the two deformed quadrangles in such a manner as to be added to the already drawn quadrangle, a graphic is drawn in which a plurality of playing cards are superposed on one another to form a deck of playing cards.

Figure 13:
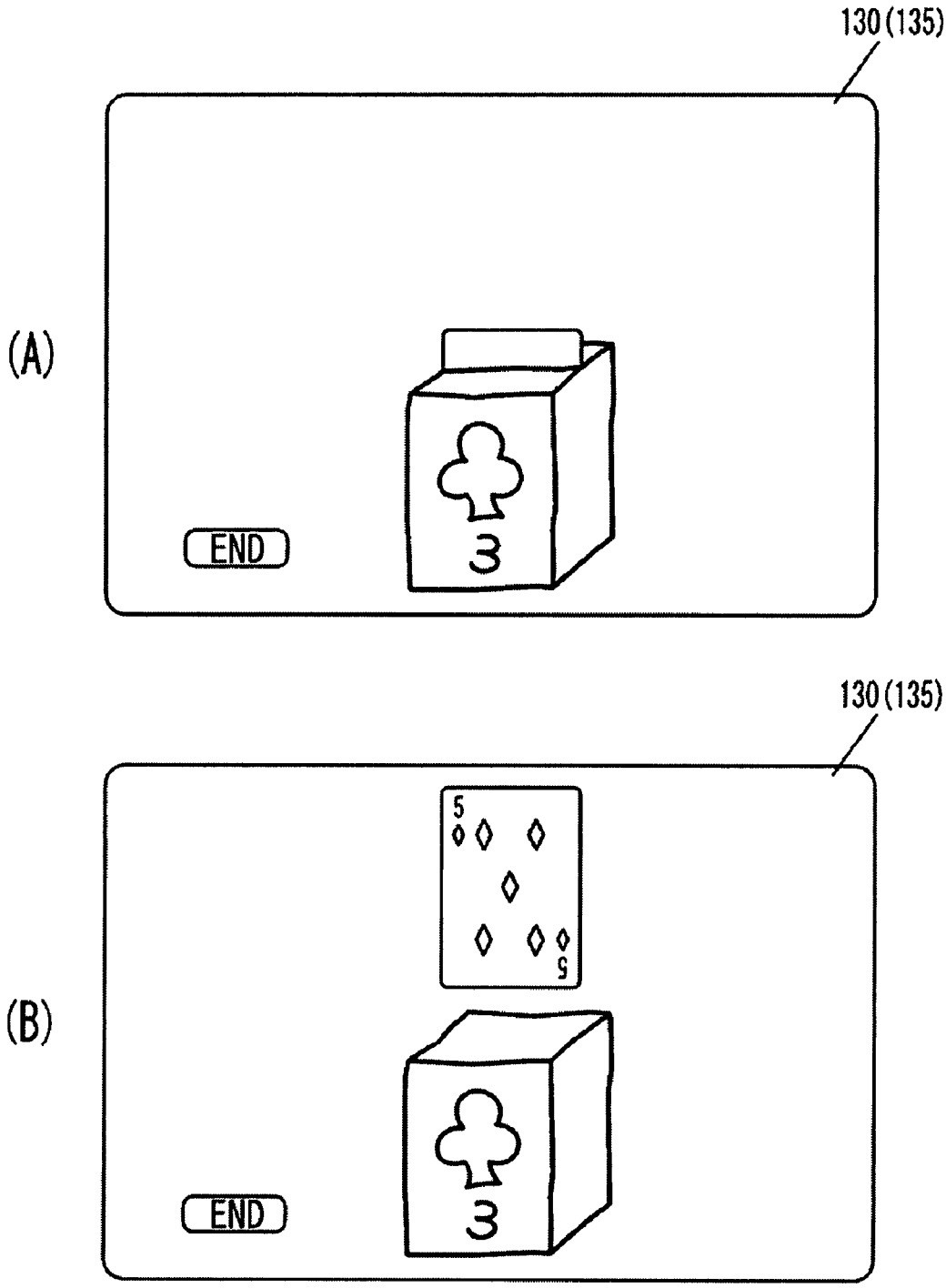
FIG. 13 shows drawings showing display examples by the display means of the third embodiment of the conjuring assisting toy according to the invention.

When the diagram in which the cards are superposed one another to form the deck, one of the superposed cards gradually rises from the deck, and the card which eventually pops up from the deck is turned out to be the card selected by the playing partner as is shown in FIG. 13, whereby a conjuring trick can be produced in which the player guesses right the card selected arbitrarily by the playing partner which the player should not know of.

In this case, too, a main control unit 112 detects an input into a touch panel 130, an input position is analyzed in an input analyzing unit 114 so that inputted position information is recorded in an inputted diagram storage unit 120, an input analyzing operation is performed while displaying inputted lines on the display means 135 by image data from an image data forming and outputting unit 118 based on the inputted position information so recorded, and as a specific data determination operation, firstly, a rectangle which is drawn is detected and determined, and when a suit marker and a number are drawn inside the rectangle after the rectangle is detected, a specific data determination operation is performed in which a specific card is determined by the suit marker and the number which were so written.

Figure 14:
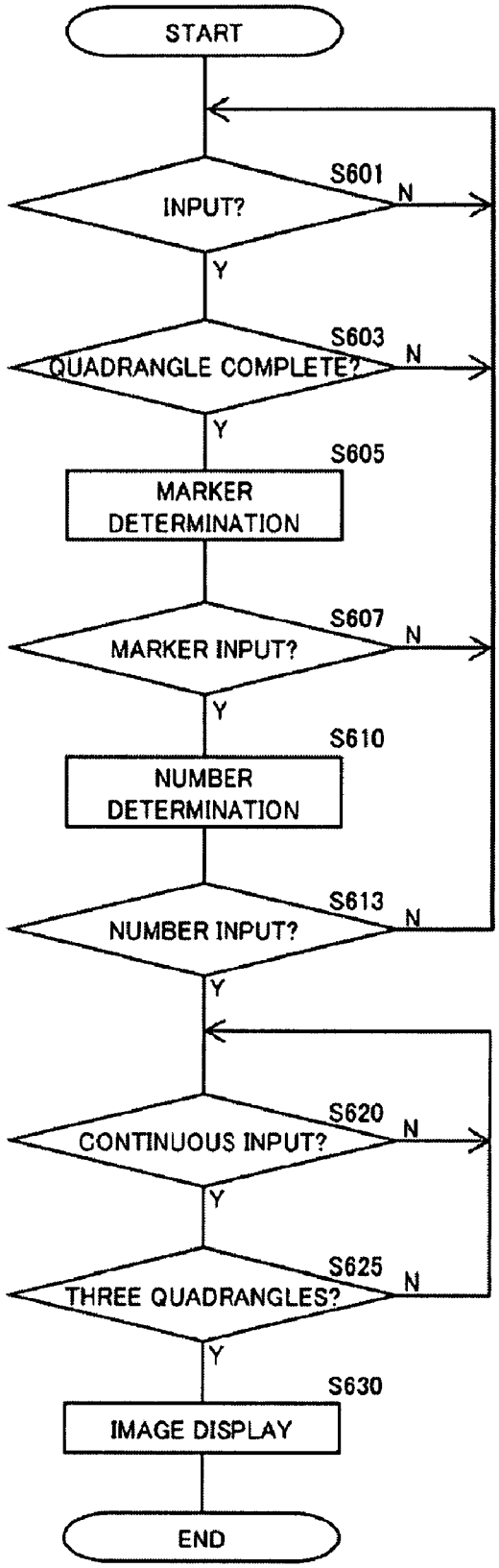
FIG. 14 is a flowchart illustrating a control operation of the third embodiment of the conjuring assisting toy according to the invention.

In these input analyzing operation and the specific data determination operation, as is shown in FIG. 14, firstly, the main control unit 112 makes a determination of whether or not there has been an input which is a determination of whether or not an input into the touch panel 130 has been made (S601). When an input into the touch panel 130 with a touch pen 170 is started, the input position signal is analyzed by the input analyzing unit 114, so that position information is caused to be stored in the inputted diagram storage unit 120, and diagram data is outputted from the image data forming and outputting unit 118 to the display means 135 based on the position information recorded in the inputted diagram storage unit 120, so that dots and lines are displayed in input positions where inputs with the touch pen 170 are performed, and when the touch pen 170 is put apart from the touch panel 130 and no input is made from the touch panel 130, whether or not a line that is completed to be drawn is connected or formed into a quadrangle is determined by determining whether or not a starting point and a terminating portion of the line so drawn is closed to each other or whether or not a line written to be added to a line that has already been drawn constitutes a substantially continuous line (S603).

In addition, if the line drawn is determined not to be the connected quadrangle, the operation flow returns again to the determination of whether or not there has been an input (S601), and when an input into the touch panel 130 is made, inputted position information is caused to be stored in the inputted diagram storage unit 120 and lines inputted are displayed on the display means 135. If no further input is made, whether or not the line is connected into the quadrangle is determined (S603), and even if the line is determined to be connected into the quadrangle, the operation flow returns again to the determination of whether or not there has been an input (S601).

Furthermore, when an input is made to draw lines in the interior of the rectangle, while causing inputted position information to be recorded in the inputted diagram storage unit 120, the lines so drawn are displayed on the display means 135, and while performing a marker determination (S605) in which a predetermined marker is detected by reading the lines drawn in the operation unit 116, whether or not the input of the marker has been completed is determined (S607). If the input of the marker has not yet been completed, the operation flow returns to the determination of whether or not there has been an input (S601), whereas if the input of the marker is completed, a number determination (S610) is performed in which whether or not predetermined numbers (1 to 13) can be read from the lines drawn within the frame in the operation unit 116 is retrieved. Whether or not the input of numbers is completed is determined by determining whether or not the predetermined numbers have been read (S613), and if the numbers are determined not to have been read, the operation flow further returns to the determination of whether or not there has been an input (S601), whereas if the numbers have been able to be read, a determination is made of whether or not a there occurs a continuous input which is a determination of whether or not a further line is inputted outside the rectangle (S620).

In this way, as the drawing order, the rectangle is first drawn based on a determination of whether or not the line drawn is connected into the rectangle which is a determination of whether or not a rectangle has been drawn (S603), and after the rectangle is drawn, a specific card is determined based on the lines, markers and numbers which are written in the interior of the rectangle so drawn.

Then, in the marker determination (S605) in which a predetermined suit marker is detected, when reading a suit marker inside the frame, the operation unit 116 causes spade to be recorded in the operation result storage unit 122 in the event that the suit marker so read is heart, causes heart to be recorded in the operation result storage unit 122 in the event that the suit marker so read is spade, causes diamond to be recorded in the operation result storage unit 122 in the event that the suit marker so read is club, and causes club to be recorded in the operation result storage unit 122 in the event that the suit marker so read is diamond, so that the markers read and the markers recorded are made to differ from each other based on certain relationships.

In addition, in the determination of the numbers (S610), when the number is such as to result from adding to or subtracting from the number read a predetermined number, and when the number which results from adding the predetermined number such as 3, for example, to the read number exceeds 13, 13 is subtracted from the relevant number so that the resulting number is made to be a number which falls within a range from 1 to 13, whereas when subtraction is performed, in the event that the number which results from subtracting the predetermined number such as 3, for example, from the read number is equal to or less than zero, 13 is added to the relevant number so that the resulting number is made to be a number which falls within the range from 1 to 13. The number which is fallen within the range from 1 to 13 resulting from adding to or subtracting from the read number is recorded in the operation result storage unit 122.

In addition, when a line is drawn outside the rectangle which was drawn initially, the main control unit 112 determines whether or not three quadrangles which share two sides have been drawn by lines which are drawn while displaying lines inputted into the display means 135 by causing inputted position information being recorded in the inputted diagram storage unit 120 by the input analyzing unit 114 (S625), and if the three quadrangles have not yet been drawn, the operation flow returns to a determination (S620) of whether or not there has been a continuous input which is a determination of whether or not there has been an input to the outside of the first quadrangle, whereas if the three quadrangles are now drawn, an image display (S630) by the image data forming and outputting 118 is caused to be performed.

This image display (630) operation is such that feature information which displays the surface graphic design of the card which is specified by the suit marker and the number of the card which are recorded in the operation result storage unit 122 is selected from a graphic design data storage area 127 in the conjuring data storage unit 125, and display data which is sequentially displayed so that the card rises gradually from the upper quadrangle of the three quadrangles is caused to be formed in the image data forming and outputting unit 118 so as to output the display data so formed to the display means 135.

In addition, as is shown in FIG. 12A, there may be a case where when any location on the screen which is made into the display means 135 is touched by the touch pen 170 after one playing card has been drawn, a state is then displayed in which the card is made to increase its thickness to be formed into a deck where playing cards are superposed on one another, and one of the deck of playing cards or the playing cards so superposed is caused to rise gradually so as to show the card selected by the playing partner.

As this occurs, in an input analyzing operation and a specific data determination operation which are shown in FIG. 14, a determination of whether or not there has been an input is made which is a determination of whether or not there has been made an input into the touch panel 130 (S601), and a determination of whether or not the line is connected into the quadrangle (S603) are performed. In addition, a marker determination (S605) and a determination (S607) of whether or not the input of the marker has been completed, and a number determination (S610) and a determination of the completion of number input (S613) which is determined by determining whether or not the number has been read, are performed, and when the mark and the number are drawn within a frame after a quadrangle is drawn, whether or not there has been made a touch input in any location on the screen is determined, and if the touch input is determined to have occurred, an image display (S630) is performed by the image data forming and outputting unit 118.

In addition, as this image display (S630) operation, three short lines are drawn obliquely upwards from three corner portions of the quadrangle drawn, respectively, and an L-shaped line is drawn in such a manner as to connect end portions of the three short lines together so that the quadrangle is made to increase its thickness as is shown in FIG. 12B, whereafter, a specific card is caused to rise gradually for display as is shown in FIG. 13.

In this way, in this conjuring assisting toy 100, when performing a conjuring trick using the conjuring playing cards, it is not just that the player simply guesses right the playing card which is selected by the playing partner who is one of the audience but that by drawing the simple lines on the conjuring assisting toy 100, changes are made to the lines and/or the displayed image, or the trick can be conjured by producing a dramatic effect by the assisting tool by employing the speech generation means, thereby making it possible to produce a dramatic effect which can make the audience feel deeper wonder and interestedness.

Note that while in the embodiments that have been described heretofore, the normal playing cards having numbers 1 to 13 on their faces are used, the invention is not limited to the use of such conjuring playing cards, and hence, even when various types of conjuring cards are used which have appropriate picture designs on their faces and on their backs designs which look similar to each other at a glance but allows the player to identify each card with hidden markers, by causing the picture designs of the cards to be stored in the conjuring data storage unit as feature information, various types of card tricks can be performed. In addition, the number of cards used is not limited to 52, and hence, even when any appropriate number such as 6, 12 and 24 is used, the cards can be identified based on inputted graphics or input order, whereby various types of card tricks can be produced.

Furthermore, while the embodiments are such as to produce the dramatic trick in which the player guesses right a card selected arbitrarily by the audience which the player should not know of using the conjuring assisting toy 100, even when the player presents the card selected by the audience using the conjuring assisting toy 100, in the event that the player draws the picture of the face as is shown in FIG. 3A, a magical interestedness can be produced in which the face guesses right the card selected arbitrarily by the audience and presented by the player, and as is shown in FIG. 8A, a magical playful effect can also be produced in which when the player only draws a simple rectangle, the card selected just now from many cards can be displayed within a frame of the rectangle so drawn.

In addition, while the conjuring assisting toy 100 shown in FIGS. 1 and 2 is the conjuring assisting toy 100 made up of the portable game machine equipped with the liquid crystal panel as the display means 135, a home television game machine using a home television as the display means 135 can also be used as the conjuring assisting toy 100.

The conjuring assisting toy 100 made up of the home television is such as to have a game machine main body which is a game machine main body connected to the television and incorporating the central control means 110 and a controller as the coordinate inputting means which is connected with the game machine main body with a wire or in a wireless fashion.

The controller, which is made into the coordinate inputting means, is such as to enable the coordinate designation input of an input position within a display area by moving a pointer displayed on the screen of the display means 135 in association with the vertical or lateral movement or rotational movement of the controller by button switches or a cross key on the controller or an acceleration sensor incorporated in the controller, so that a line as a locus of the pointer is displayed on the display means 135 by moving the pointer on the screen.

What is claimed is:

1. A conjuring assisting toy, comprising:

display means for displaying an image;

coordinate inputting means for designating coordinates relative to a display area of the display means;

central control means; and speech generation means, wherein:

the central control means comprises a main control unit, a conjuring data storage unit, an input analyzing unit and an operation unit, an operation result storage unit, an inputted diagram storage unit, and an image data forming and outputting unit;

the input analyzing unit analyzes an inputted position signal from the coordinate inputting means;

the conjuring date storage unit stores feature information of conjuring tools and has a speech data storage area;

the main control unit causes position information based on the inputted position signal which is sent from the input analyzing unit to be stored in the inputted diagram storage unit, causes the display means to display a line image inputted by the coordinate inputting means by causing diagram data to be outputted from the image data forming and outputting unit based on the position information;

the operation unit selects and determines specific feature information from the conjuring data storage unit based on drawing order information on an inputted diagram which is inputted from the coordinate inputting means or input starting position information and line shape information on the inputted diagram;

the inputted diagram is received within a computer generated boundary; and when the operation unit selects and determines specific feature information from the information stored in the conjuring data storage unit, the main control unit causes part of the diagram which is caused to be displayed on the display means by the image data forming and outputting unit to be changed to display a time-varying image and reads out speech data which enables the contents of the specific feature information to be expressed by speech from the speech data storage area and causes the speech generation means to output the contents of the specific feature information by speech.

2. A conjuring assisting toy as set forth in claim 1, wherein:

the conjuring data storage unit stores as feature information graphic design data or character data and speech data on four suit markers and numbers one to thirteen which are provided on playing cards used as a conjuring tool;

the main control unit causes the display means to display twelve dots which are disposed in a circle less conspicuously;

the operation unit determines specific feature information based on a drawing order of a circular line drawn in a vicinity of a position of the dots and a plurality of lines drawn within the circular line; and when specific feature information is determined, the main control unit causes the image data forming and outputting unit to change among lines drawn at least a lower line which is drawn within the circle and reads out the speech data and causes the speech generation means to output the contents of the specific feature information by speech.

3. A conjuring assisting toy, comprising:

display means for displaying an image;

coordinate inputting means for designating coordinates relative to a display area of the display means; and central control means wherein the central control means comprise:

a main control unit;

a conjuring data storage unit;

an input analyzing unit;

an operation unit;

an operation result storage unit;

an inputted diagram storage unit; and an image data forming and outputting unit, wherein:

the input analyzing unit analyzes an inputted position signal from the coordinate inputting means;

the conjuring date storage unit stores feature information of conjuring tools;

the main control unit causes position information based on the inputted position signal which is sent from the input analyzing unit to be stored in the inputted diagram storage unit, causes the display means to display a diagram inputted by the coordinate inputting means by causing diagram data to be outputted from the image data forming and outputting unit based on the position information;

the operation unit selects and determines specific feature information from the conjuring data storage unit based on drawing order information on an inputted diagram which is inputted from the coordinate inputting means or input starting position information and line shape information on the inputted diagram;

the inputted diagram is received within a computer generated boundary; and when the operation unit selects and determines specific feature information from the information stored in the conjuring data storage unit, the main control unit allows a picture image or text image based on the specific feature information so selected and determined to be displayed in addition to the diagram which has already been displayed on the display means by the image data forming and outputting unit.

4. A conjuring assisting toy as set forth in claim 3, wherein:

the conjuring data storage unit stores therein back graphic design data of playing cards which constitutes conjuring tools and graphic design data of face graphic design data of each of the playing card as feature information;

the operation unit determines a specific playing card based on a drawing order of a diagram drawn into a rectangle; and when a specific playing card is determined, the main control unit picks up a back graphic design data of the playing card from the conjuring data storage unit and causes the image data forming and outputting unit to display the back of the playing card within a frame of the diagram and then picks up feature information on the specific playing card from the conjuring data storage unit and causes the image data forming and outputting unit to display a face of the specific playing card as a display of an image or text based on feature information of a specified conjuring tool within a frame of the diagram.

5. A conjuring assisting toy as set forth in claim 3, wherein:

the conjuring data storage unit stores therein graphic design data of a face graphic design of each of playing cards which constitutes conjuring tools as feature information;

the operation unit determines a specific playing card by a marker and a number which are drawn inside a rectangle after the rectangle has been drawn on the display means; and when two quadrangle diagrams which are adjacent to two sides of the rectangle are inputted and displayed on the display means by a player through the coordinate inputting means after a specific playing card is determined, the main control unit causes the image data forming and outputting unit to display a face image of the specific playing card which is determined in the operation unit, in addition to those diagrams which have already been displayed on the display means, so as to rise gradually from a quadrangle which is positioned upwards in the two quadrangle diagrams.

6. A conjuring assisting toy as set forth in claim 3, wherein:

the conjuring data storage unit stores therein graphic design data of a face graphic design of each of playing cards which constitutes conjuring tools as feature information;

the operation unit determines a specific playing card by a marker and a number which are drawn inside a rectangle after the rectangle has been drawn on the display means; and when an input is made to the coordinate inputting means after a specific playing card is determined, the main control unit causes the image data forming and outputting unit to additionally draw on the display means two quadrangle diagrams which are adjacent to two sides of the rectangle which has already been drawn and to display a face image of the specific playing card which is determined in the operation unit so as to rise gradually from the quadrangle which is positioned upwards in the two quadrangles.

* * * * *